US006003861A

United States Patent [19]

Iizumi et al.

[11] Patent Number: 6,003,861

[45] **Date of Patent: *Dec. 21, 1999**

[54] SHEET LOADING APPARATUS HAVING MEANS FOR MEASURING DISTANCE FROM SHEET ON TRAY

[75] Inventors: Kenichi Iizumi, Ibaraki-ken; Hideaki Furukawa; Noriaki Nakazawa, both of Yokohama, all of Japan

[73] Assignee: Canon Aptex Kabushiki Kaisha, Ibaraki-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/824,458

[22] Filed: Mar. 26, 1997

[30] Foreign Application Priority Data

Mar. 28, 1996 [JP] Japan ..... 8-074964

[51] Int. Cl.[6] ..... B65H 43/04

[52] U.S. Cl. ..... 271/215; 271/217

[58] Field of Search ..... 271/215, 217, 271/214

[56] References Cited

U.S. PATENT DOCUMENTS

| | | | |
|---|---|---|---|
| 4,189,133 | 2/1980 | Arrasmith et al. | 271/215 X |
| 4,229,650 | 10/1980 | Yuji et al. | 271/215 X |
| 5,017,972 | 5/1991 | Daughton et al. | 355/321 |

FOREIGN PATENT DOCUMENTS

| | | |
|---|---|---|
| 0 757 964 | 2/1997 | European Pat. Off. . |
| 40 13 423 A1 | 10/1991 | Germany . |
| 60-098451 | 6/1985 | Japan . |

OTHER PUBLICATIONS

Fotoelektrisch Steuerung von Papier–und Pappenstapeln; *Elektrotechnick*; Oct. 12, 1996; No. 33; pp. 772–773.

Patent Abstracts of Japan; translation of abstract for Japanese Patent Publication No. 07–172684, published Jul. 11, 1995.

Patent Abstracts of Japan; translation of abstract for Japanese Patent Publication No. 60–098451, published Jun. 1, 1985.

*Primary Examiner*—David H. Bollinger

*Attorney, Agent, or Firm*—Fitzpatrick, Cella, Harper & Scinto

[57] ABSTRACT

A sheet loading apparatus includes an ejecting unit for ejecting sheets from an image forming apparatus onto a tray, a non-contact distance measuring unit disposed on the tray to measure the distance between the upper surface of the sheet bundle on the tray and a predetermined position, a lifting unit for vertically shifting the tray, and a unit for performing sheet loading abnormality detection on the tray, vertical shift control for the tray, sheet presence/absence detection on the tray, and sheet loading amount detection on the tray in accordance with the distance measuring result of the distance measuring unit.

51 Claims, 37 Drawing Sheets

| FIG. 37A | FIG. 37B |
|---|---|

SHEET LOADING APPARATUS HAVING MEANS FOR MEASURING DISTANCE FROM SHEET ON TRAY

BACKGROUND OF THE INVENTION

1. Field of the Invention

The present invention relates to a sheet loading apparatus having a means for measuring the distance from sheets on a tray.

2. Related Background Art

Some conventional image forming apparatuses such as copying machines and laser printers have post-processing apparatuses for performing post-processing such as sheet binding. In such a post-processing apparatus, as shown in FIG. 46, a tray 103 serving as a sheet table is mounted on a vertically movable tray shift table 102, and a sheet level detecting sensor 105 for detecting that the number of sheets S ejected to the tray 103 has reached a predetermined number is arranged on an upper swinging guide 88.

The sheet level detecting sensor 105 comprises a pivotal lever 106 having an axially supported upper end portion and resting in contact with the sheets S loaded on the tray 103, and a photosensor 107 for outputting a predetermined signal upon pivotal shifting of the lever 106 by a predetermined angle. The lever 106 gradually pivots upward as the number of sheets S loaded on the tray 103 increases. For this reason, whether the distance between the upper surface of the uppermost one of the sheets S and a sheet ejecting port 50 has reached a predetermined value can be detected.

In the conventional apparatus, however, since the sheet bundle height on the tray is detected using the lever, the distance between the sheet ejecting port and the upper surface of the uppermost sheet cannot be kept at a fixed distance that depends on the lever position, and the sheet loadability is limited. In addition, since the lever extends over the tray, a plurality of trays cannot be mounted or changed.

The trailing end of a sheet which is caught at the ejecting unit is often kept bent due to the differences in the type of sheet to be ejected, ejecting speed, and the like (see FIG. 47). The conventional apparatus described above cannot detect this bent state.

The sheet whose trailing end is caught and kept bent at the ejecting unit may be pushed by the next sheet to drop from the tray and scatter.

SUMMARY OF THE INVENTION

It is an object of the present invention to provide a sheet loading apparatus capable of properly loading sheets.

It is another object of the present invention to provide a sheet loading apparatus using a distance measuring means of a non-contact type to measure the distance to the upper surface of the uppermost sheet on the tray.

It is still another object of the present invention to provide a sheet loading apparatus which does not have a mechanical switch extending on the tray and is adapted to detect sheets on the tray.

It is still another object of the present invention to provide a sheet loading apparatus in which abnormalities of sheet loading, the loading amount, vertical shift control of a tray, the presence/absence of sheets on the tray, and sheets on a plurality of trays can be detected by one distance measuring unit.

DETAILED DESCRIPTION OF THE PREFERRED EMBODIMENTS

Preferred embodiments of the present invention will be described with reference to the accompanying drawings.

Figure 1:
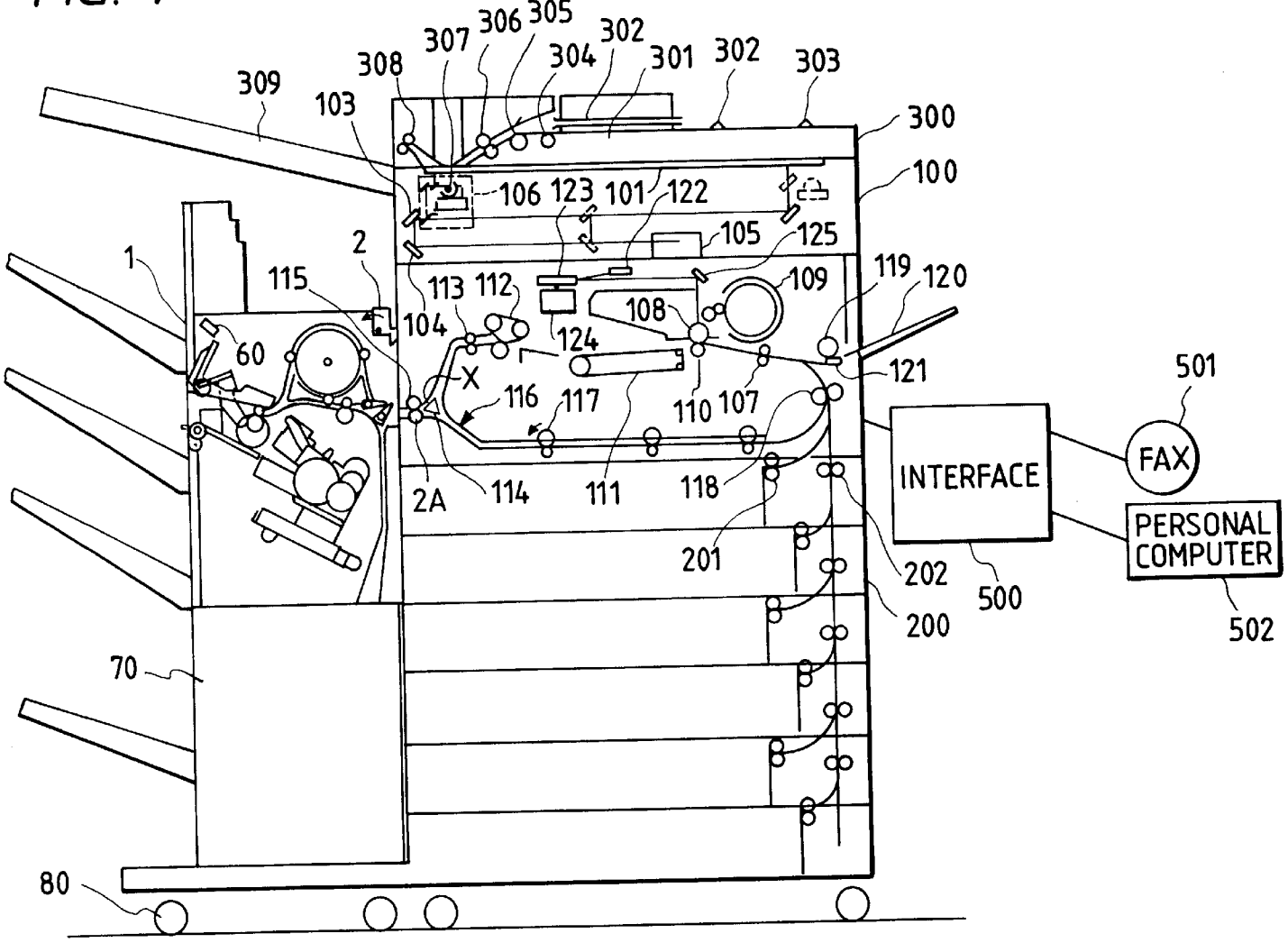
FIG. 1 is a side sectional view of a sheet post-processing apparatus and a copying apparatus, in which the present invention is practiced.

FIG. 1 is a view showing a system configuration to which the present invention can be applied. Referring to FIG. 1, the system includes a sheet post-processing apparatus 1 according to the present invention, a copying apparatus 100 as an example of an image forming apparatus, cassettes 200 on which a plurality of sheets having difference sizes are loaded, and an automatic document feeder (to be referred to as an ADF hereinafter) 300 for automatically feeding an original.

The copying apparatus 100 comprises an original glass table 101 for placing an original thereon, scanning reflecting mirrors (scanning mirrors) 103 and 104, a lens 105 having focusing and magnification functions, and a first scanning mirror carriage 106 having an illumination lamp and a mirror to read an original fed from the ADF 300.

The copying apparatus 100 also comprises registration rollers 107, a photosensitive drum 108, a press roller 110, a conveyor belt 111 for conveying an image-recorded recording sheet to the fixing side, a fixing unit 112 for thermally fixing an image on the conveyed recording sheet, conveying rollers 113 and 117 for conveying the recording sheet, a flapper 114 for changing the conveying direction of the conveyed recording sheet, a conveying roller 115 for conveying the recording sheet to the sheet post-processing apparatus, a reversing path 116 for reversing the recording sheet, and a conveying roller 118 for conveying the sheet from the cassette 200 and the reversing path 116 to the photosensitive drum unit. A roller 119, a tray 120, and a separation pad 121 convey a sheet from a manual feed unit. The copying apparatus 100 further comprises a laser source 122 for forming an image on the photosensitive drum 108, a polygon mirror 123, a mirror 125 for changing the optical path, and a motor 124 for pivoting the polygon mirror 123.

Each cassette 200 has conveying rollers 201 for picking up a sheet from this cassette 200, and intermediate rollers 202 for transferring the sheet picked up from the cassette 200 upward.

The surface of the photosensitive drum 108 comprises a seamless photosensitive body using a photoconductor and a conductor. This drum 108 is axially supported to be pivotal and starts rotating in the direction of an arrow in response to depression of a copy start key by means of a main motor (not shown). When predetermined rotation control and potential control processing (preprocessing) of the drum 108 are complete, an original placed on the original glass table 101 is illuminated with the illumination lamp integrally formed with the first scanning mirror 106. Light reflected by the original passes through the lens 105 via the scanning mirrors 103 and 104 and forms an image on a light-receiving element inside the lens unit.

The image of light reflected by the original is converted into an electrical signal by the light-receiving element, and the electrical signal is sent to an image processing unit (not shown). On the other hand, predetermined data received from the user to the main body is processed in this image processing unit, and the processed data is sent to the laser light source 122. The data-processed electrical signal is converted into light by the laser source 122, and the laser beam is reflected by the polygon mirror 123 and the mirror 125 to form an electrostatic latent image on the photosensitive drum 108. The latent image is visualized with toner, and the toner image is transferred to a transfer sheet, as will be described later.

A transfer sheet set on the cassette 200 or the manual feed tray 120 is fed into the copying apparatus 100 by the rollers 118, 119, 201, and 202. The sheet is then set at an accurate timing by the registration rollers 109 and fed to the photosensitive drum 108, so that the leading end of the latent image matches the leading end of the transfer sheet. When the transfer sheet passes between the photosensitive drum 108 and the roller 110, the toner image on the drum 108 is transferred to the transfer sheet.

Thereafter, the transfer sheet is separated from the drum 108 and guided to the fixing unit 112 by the conveyor belt 111. The image is fixed by heating under pressure. The image-formed transfer sheet (to be referred to as a sheet hereinafter) is switched by the flapper 114 to enter the reversing path 116. When the trailing end of the sheet completely passes through the flapper 114, the conveying roller 117 rotates in a direction opposite to the direction of the arrow in FIG. 1. The sheet travels in the opposite direction along the path 116. The leading end of this sheet is guided in the direction from the flapper 114 to the ejecting roller 115. The sheet is output outside the post-processing apparatus 1 with the printed surface facing down.

On the other hand, the ADF 300 comprises a loading tray 301 for placing a bundle 302 of originals with their image surfaces facing down. The sheets are conveyed one by one from the lowermost sheet by a pickup roller 304. A separating means 305 feeds out the sheets one by one from the lowermost sheet when a plurality of originals are fed out. A pair of registration rollers 306 align the leading end of the separated original. Note that an original having passed through the registration rollers 306 is read by so-called guided reading while the mirror carriage 106 is fixed in a reading unit 307. The original is then loaded on an ejecting tray 309 through ejecting rollers 308.

A digital copying machine comprises a "scanner unit" for reading the image of an original and a "printer unit" for printing out the image. These two units can be operated independently of each other.

In the scanner unit, an original is illuminated with a lamp, and light reflected by the lamp is split into small points (pixels) and converted (photoelectric conversion) into an electrical signal corresponding to the density of the original. In the printer unit, a photosensitive drum is illuminated with a laser beam on the basis of the electrical signal sent from the scanner unit to form an electrostatic latent image on the photosensitive drum. The latent image is developed, transferred, and fixed, thereby obtaining a copy image.

When an interface 500 is connected to the digital copying machine, the electrical signal of the original read by the scanner unit can be transferred to another facsimile apparatus (FAX) 501, or an electrical signal received from the facsimile apparatus 501 can be sent to the printer unit through the interface 500, thereby printing the image on a transfer sheet.

Similarly, an image received from computer equipment such as a personal computer 502 can be sent to the printer unit through the interface 500 to print the image on a transfer sheet, or an image read by the scanner unit can be fetched by the personal computer 502 through the interface 500.

As described above, in the digital copying machine of this embodiment, the image of an original fed from the ADF 300 or placed on the platen glass is read and copied. In addition, the digital copying machine can be used as the printer of the facsimile apparatus 501 or the personal computer 502 through the interface 500.

A stopper member 2 is disposed in the upper portion of the sheet post-processing apparatus 1. When the sheet post-processing apparatus 1 is to be connected to the copying apparatus 100, the stopper member 2 is positioned at a holding portion 2A formed on the side surface of the copying apparatus 100. A folder unit or mounting base 70, which supports the sheet post-processing apparatus 1, is disposed below the sheet post-processing apparatus 1. Casters 80 are attached to the bottom portions of the mounting base 70 so as to make the sheet post-processing apparatus 1 movable.

Jam processing near the ejecting unit of the copying apparatus 100 or jam processing between the sheet post-processing apparatus 1 and the copying apparatus 100 can be easily performed when the stopper member 2 is released, and the sheet post-processing apparatus 1 is horizontally operated to the left to be separated from the copying apparatus 100.

Figure 2:
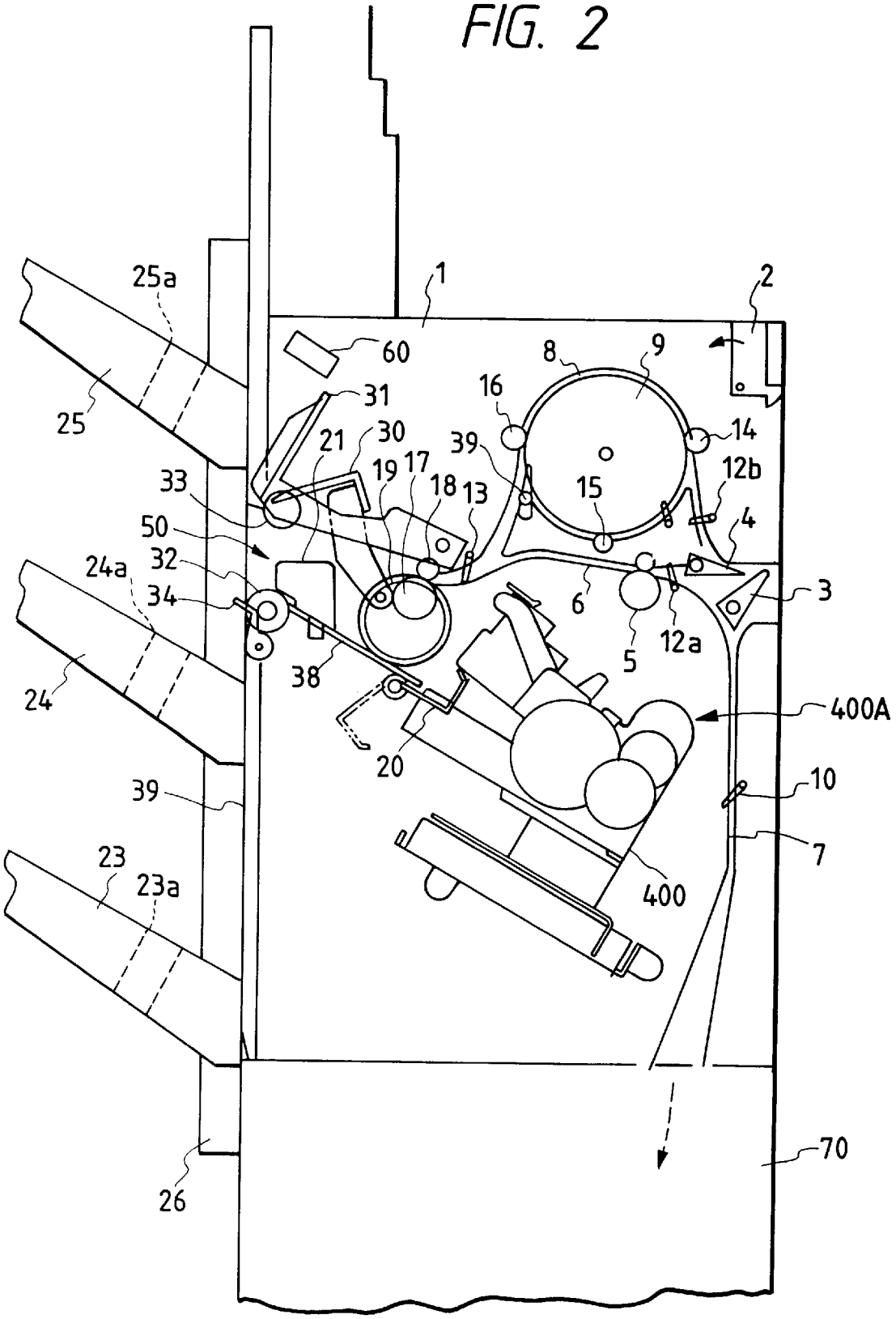
FIG. 2 is a side sectional view of the sheet post-processing apparatus.

In processing the sheet in the sheet post-processing apparatus 1, the upstream end portion of a flapper 3 is located at the lower position in FIG. 2, and the upstream end portion of a flapper 4 is located at the upper position in FIG. 2, so that the sheet ejected from the ejecting unit of the copying apparatus 100 is conveyed to a first conveying path 6 through a pair of rollers 5. When a sheet is to be conveyed to the folder 70, the upstream end portion of the flapper 3 is located at the upper position, and the sheet is fed in the direction of an arrow indicated by a broken line through a third conveying path 7.

Referring to FIG. 2, the sheet post-processing apparatus 1 comprises a second conveying path (buffer path) 8 which bypasses the first conveying path 6, a buffer roller 9, buffer rollers 14, 15, and 16, and sheet detection sensors 10, 11, 12*a*, 12*b*, and 13 for detecting passing and jammed sheets.

A press roller 18 is in contact with a first ejecting roller 17 to rotate therewith. An ejecting aligning belt 19 rotates between the first ejecting roller 17 and the press roller 18. An endless rib (not shown) formed near the central portion of the inner side of the belt is engaged in the circumferential groove of the first ejecting roller 17 to prevent accidental removal of the belt.

An abutment plate 20 comes into contact with the trailing ends of sheets to align the sheets in the longitudinal direction in stapling. The abutment plate 20 is located at the home position where the trailing ends of the sheets are sequentially aligned and the retracted position where the abutment plate 20 does not interfere with shifts of a stapler 400. In shifting the stapler 400, the abutment plate 20 pivots to the retracted position indicated by a broken line, thereby preventing interference with shifts of the stapler 400.

Figure 3:
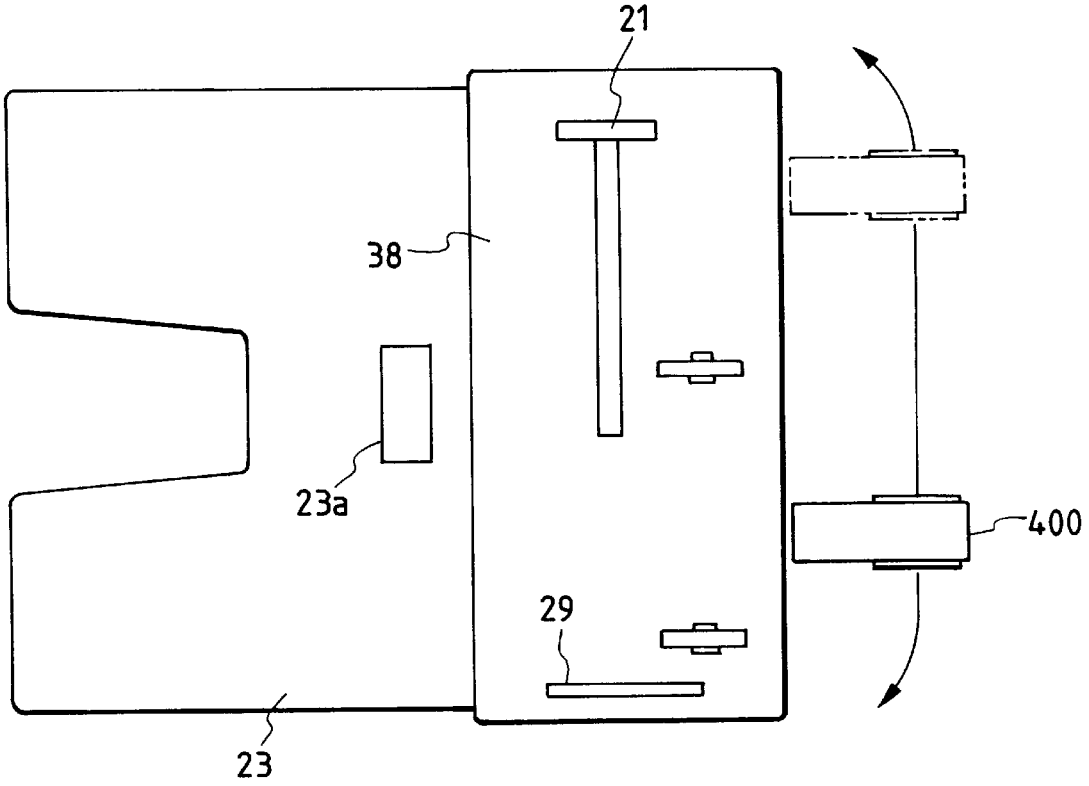
FIG. 3 is a plan view of a staple tray unit in the sheet post-processing apparatus.
Figure 4:
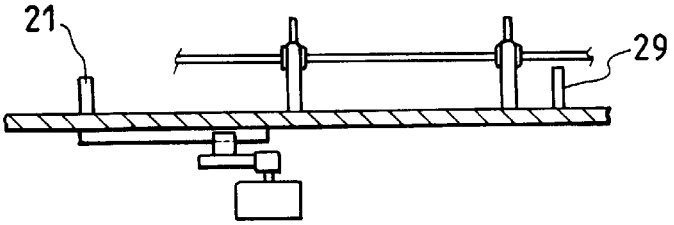
FIG. 4 is a side sectional view of the stable tray unit.

The sheets are aligned by a width aligning guide 21 in the widthwise direction of the sheets, as shown in FIGS. 3 and 4. The stapler 400 shifts within a range indicated by an arrow in FIG. 3 and binds the sheets at two points, i.e., one point at the front side and the other point at the rear side with reference to an aligning reference plate 29 in FIGS. 3 and 4.

Figure 5:
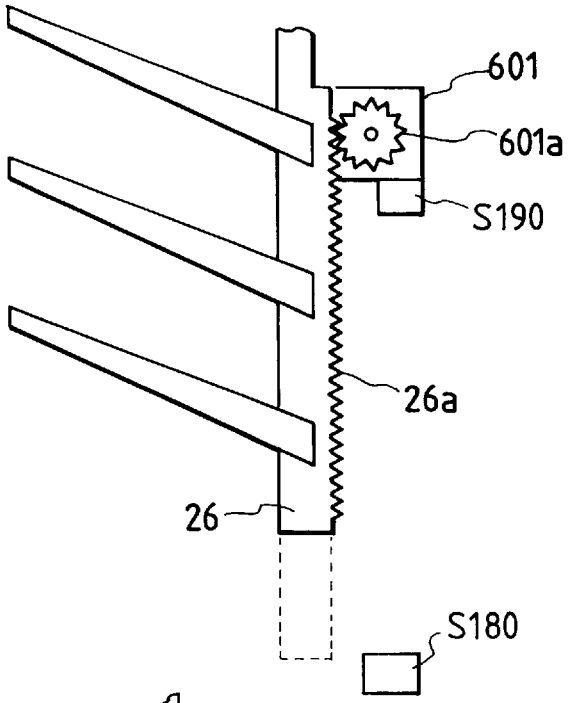
FIG. 5 is a side view showing the main part of a tray unit in the sheet post-processing apparatus.

Referring back to FIG. 2, first, second, and third trays 23, 24, and 25 serve as sheet storing means for loading and storing sheets ejected from an ejecting port 50. A tray unit 26 serves as a table unit that vertically shifts while holding the first, second, and third trays 23, 24, and 25. As shown in FIG. 5, a driving unit serving as a shift means is formed below the tray unit 26. Meshing a lifting gear 601*a* with a rack gear 26*a* formed on the tray unit 26 and rotating the lifting gear 601*a* vertically shift the tray unit 26.

Figure 6:
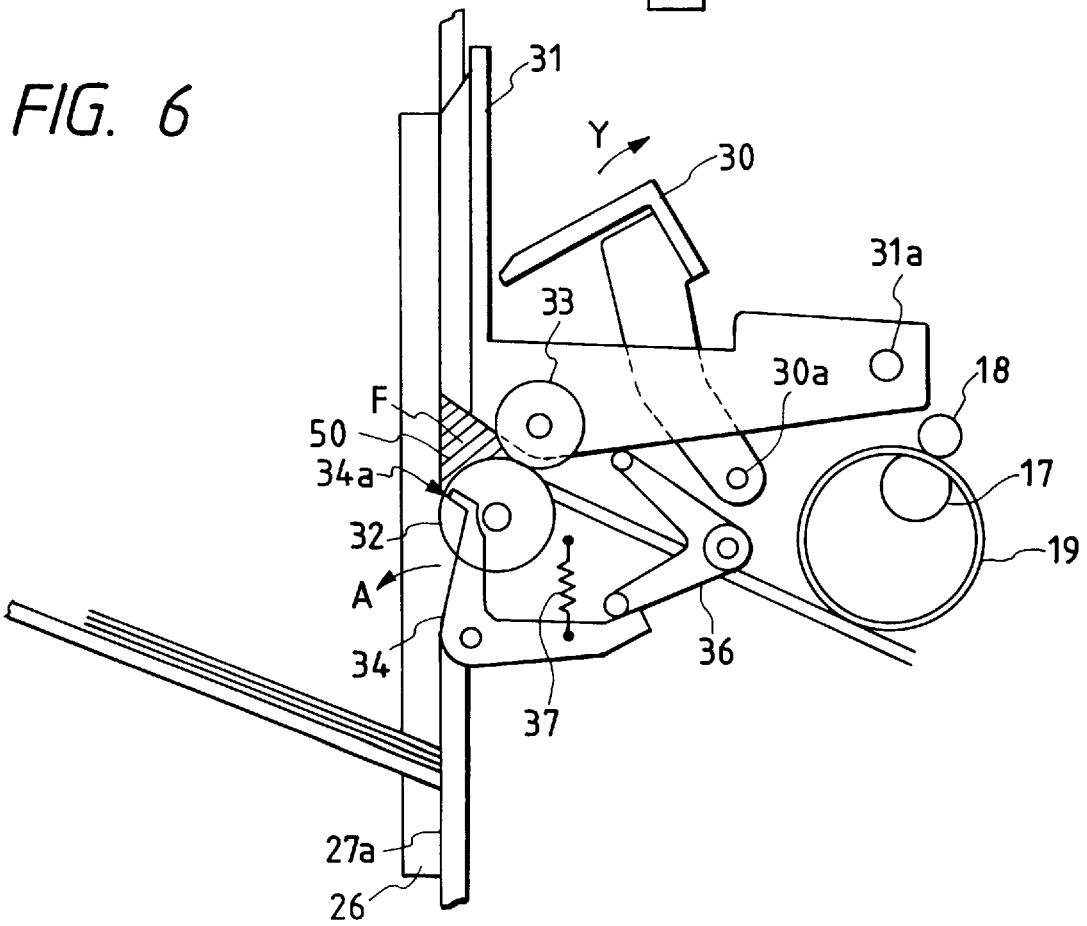
FIG. 6 is an enlarged sectional view showing the main part of the sheet post-processing apparatus.

Referring to FIG. 2, a swinging guide 31 rotatably holds a shift ejecting roller 33, as shown in FIG. 6. The swinging guide 31 pivots downward about a pivot shaft 31*a*, as shown in FIG. 6, upon rotation of a cam 35 shown in FIG. 7 by an ejecting motor 35*a* in the direction of an arrow in FIG. 7. Therefore, the swinging guide 31 presses the shift ejecting roller 33 onto an ejecting roller 32.

Figure 9:
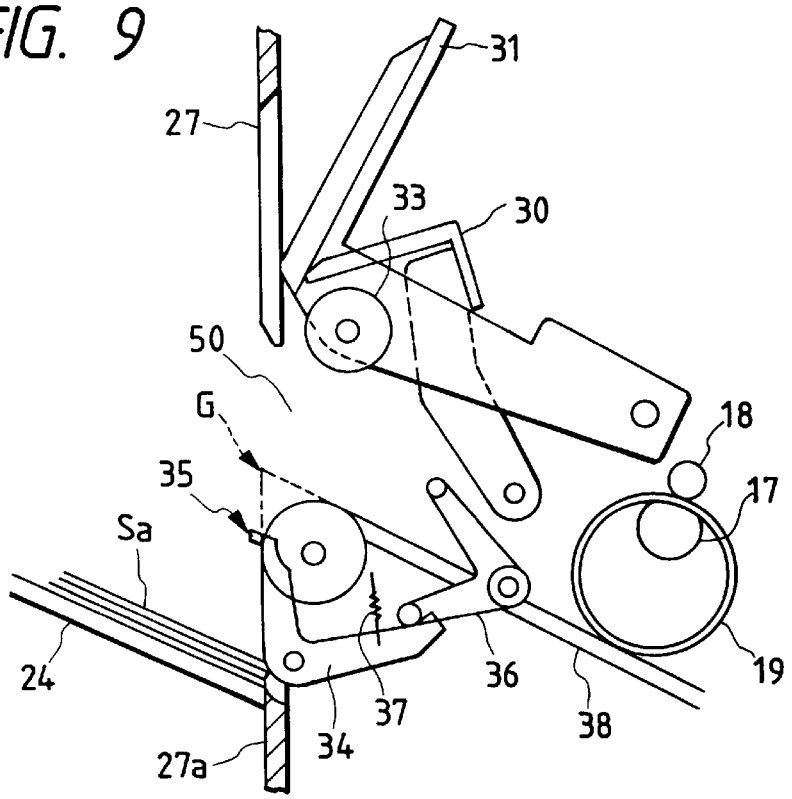
FIG. 9 is a side view showing a state in which the swinging guide has swung to the upper position.

In the staple mode (to be described later), the swinging guide 31 pivots to a position wherein the shift ejecting roller 33 is spaced apart from the ejecting roller 32, as shown in FIG. 9. A roller pair constituted by the shift ejecting roller 33 and the ejecting roller 32 are set from a sheet ejecting enable state to a sheet ejecting disable state.

Figure 8:
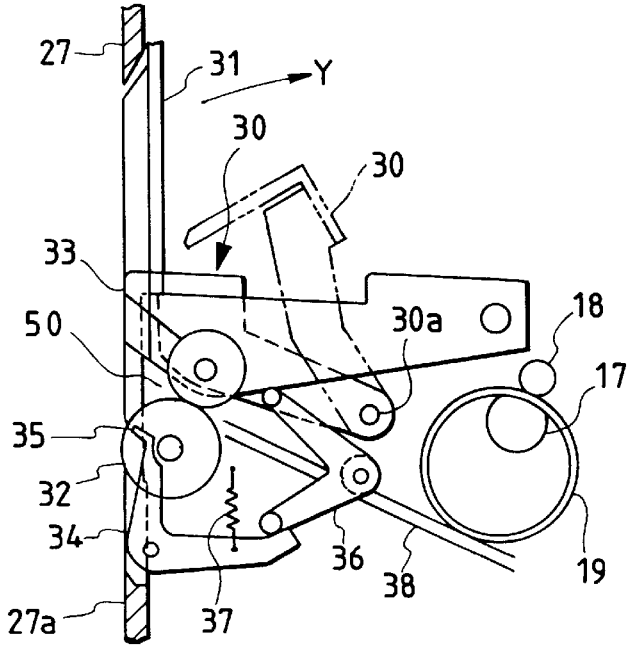
FIG. 8 is a side view showing a state in which a stopper in the sheet post-processing apparatus closes an ejecting port.

In shifting a tray, a stopper 30 pivots about a pivot shaft 30*a* to close the ejecting port 50, as indicated by a solid line in FIG. 9. When the ejecting port 50 is closed in this manner, the sheets loaded on the tray can be prevented from flowing in the reverse direction upon passing the tray through the ejecting port 50. An upper hurdle guide 27 is disposed, as shown in FIG. 8.

In ejecting a sheet, the stopper 30 pivots in the direction of an arrow Y in FIG. 6 to open the ejecting port 50. In the staple mode (to be described later), the stopper 30 pivots together with the swinging guide 31 in a direction to open the ejecting port 50, as shown in FIG. 9.

Referring to FIG. 6, a roller guide 34 is pivotally arranged such that its lower end portion is axially supported between a lower hurdle guide 27*a* and the ejecting port 50. At the same time, a locking pawl 34*a* projects outward from the upper end portion of the roller guide 34. When the swinging guide 31 pivots downward, the roller guide 34 pivots through a link 36 while stretching a spring 37. The locking pawl 34*a* is retracted to a position where the distal end of the locking pawl 34*a* is located inside the apparatus 1 from at least the front end of the ejecting roller 32.

Figure 10:
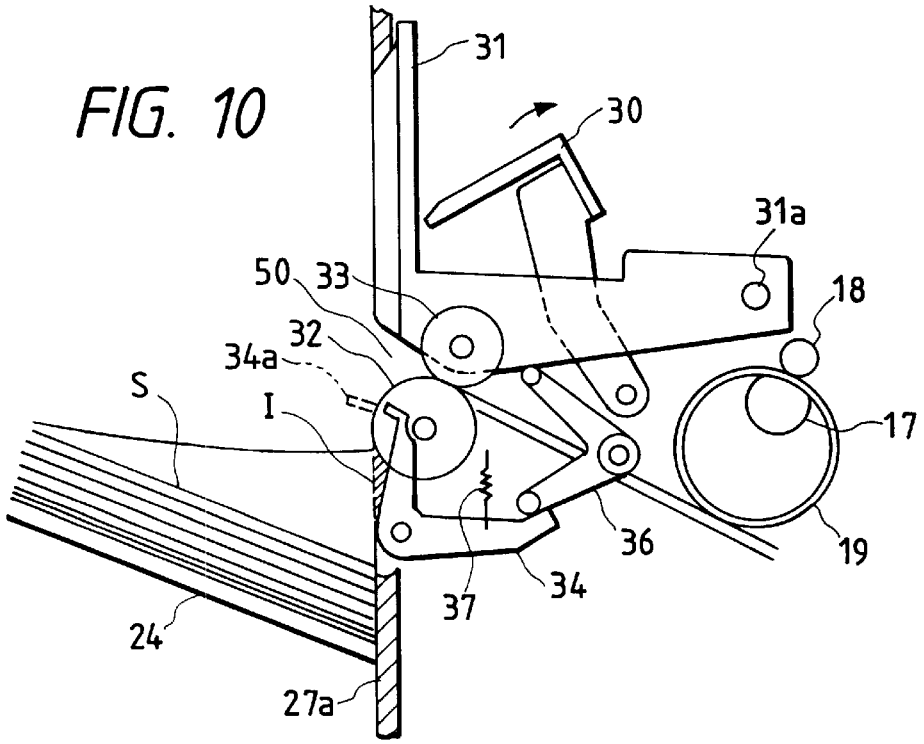
FIG. 10 is a side view showing a state in which a roller guide in the sheet post-processing apparatus is located at a position where an escaping portion is formed.

In sheet ejecting, when the roller guide 34 is retracted as described above, the sheet S is prevented from being caught between the roller guide 34 and the ejecting roller 32. As shown in FIG. 10, the roller guide 34 can form an escaping surface indicated by hatched lines I with the lower hurdle guide 27*a*. Therefore, the ejected sheets S can be smoothly guided to the tray 24.

As shown in FIG. 6, the roller guide 34 is biased by the spring 37 in the direction of an arrow A, as shown in FIG. 6. In the staple mode, the roller guide 34 is held at a position where it has the same level as that of the lower hurdle guide 27*a*, as shown in FIG. 9. The roller guide 34 is made to be at the same level as that of the lower hurdle guide 27*a*, as described above. In the staple mode, even if the inclined end of a sheet Sa loaded on the tray 24 is curved (curled) upward, the inclined end will not be caught between the lower hurdle guide 27*a* and the ejecting roller 32.

In the staple mode, the locking pawl 34*a* projects above the tray 24, as shown in FIG. 9. Even if the inclined end of the sheet S is curved upward, its upper end does not exceed point G. The next sheet will not be caught or jammed, and alignment of the width aligning guide 21 can be prevented from being degraded by the load of the caught or jammed sheet.

Referring to FIG. 2, a non-contact distance sensor 60 comprises an irradiation unit for irradiating light toward the trays 23, 24, and 25 and a light-receiving unit for receiving reflected light of the irradiated light. A CPU serving as a control unit (to be described later) operates the distance sensor 60, e.g., every ejecting operation or binding operation to irradiate the trays 23, 24, and 25 with light and obtains the distances between the distance sensor 60 and the sheets loaded on the trays 23, 24, and 25 in accordance with the positions on the light-receiving unit which receives the reflected light.

In addition, the CPU determines the sheet loaded states of the trays 23, 24, and 25 on the basis of the obtained distances, controls to drive a shift motor 601 in accordance with the determination results, and vertically shifts the tray unit 26, thereby shifting the respective trays 23, 24, and 25.

Figure 11:
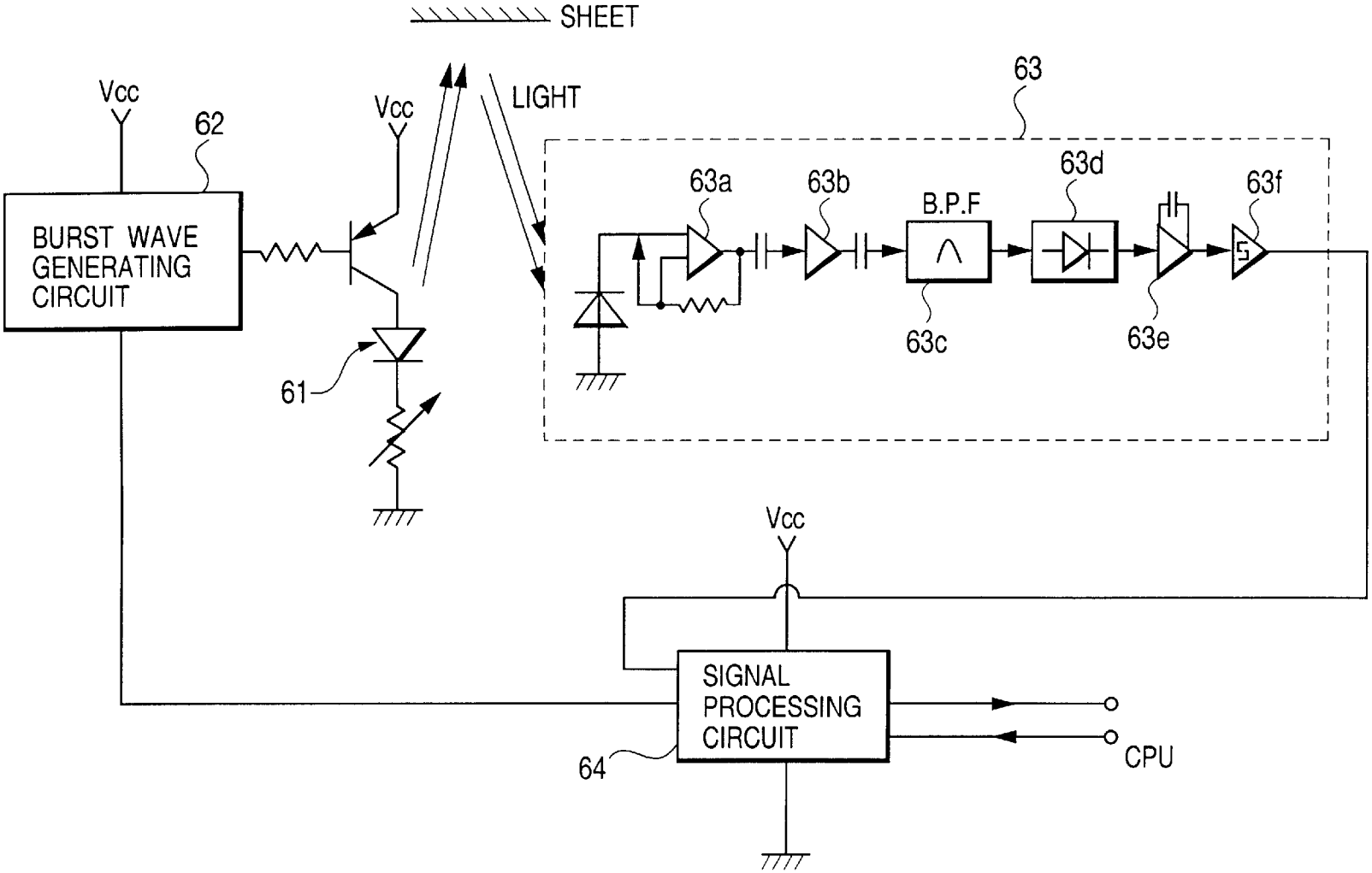
FIG. 11 is a block diagram of a distance measuring sensor in the sheet post-processing apparatus.

FIG. 11 is a simple block diagram of this distance sensor 60. The distance sensor 60 comprises a light-emitting element (LED) 61, and a burst wave generating circuit 62 for generating a signal for operating the light-emitting element 61. The burst wave generating circuit 62 constitutes the irradiation unit together with the light-emitting element 61.

A PSD (Position-Sensitive-Detector) light-receiving element 63 is arranged in the light-receiving unit for receiving light reflected by a sheet upon irradiating light from the light-emitting element 61 toward the first, second, and third trays 23, 24, and 25.

The PSD light-receiving element 63 comprises an amplifier 63*a*, a limiter 63*b*, a bandpass filter (B.P.S) 63*c*, a demodulator 63*d*, an integrator 63*e*, and a comparator 63*f*. The PSD light-receiving element 63 generates currents having different magnitudes corresponding to varying light-receiving distances of the reflected light beams from the sheet surfaces. A signal processing circuit 64 outputs a trigger signal to the burst wave generating circuit 62 and converts a current from the PSD light-receiving element 63 into voltage information.

Figure 12:
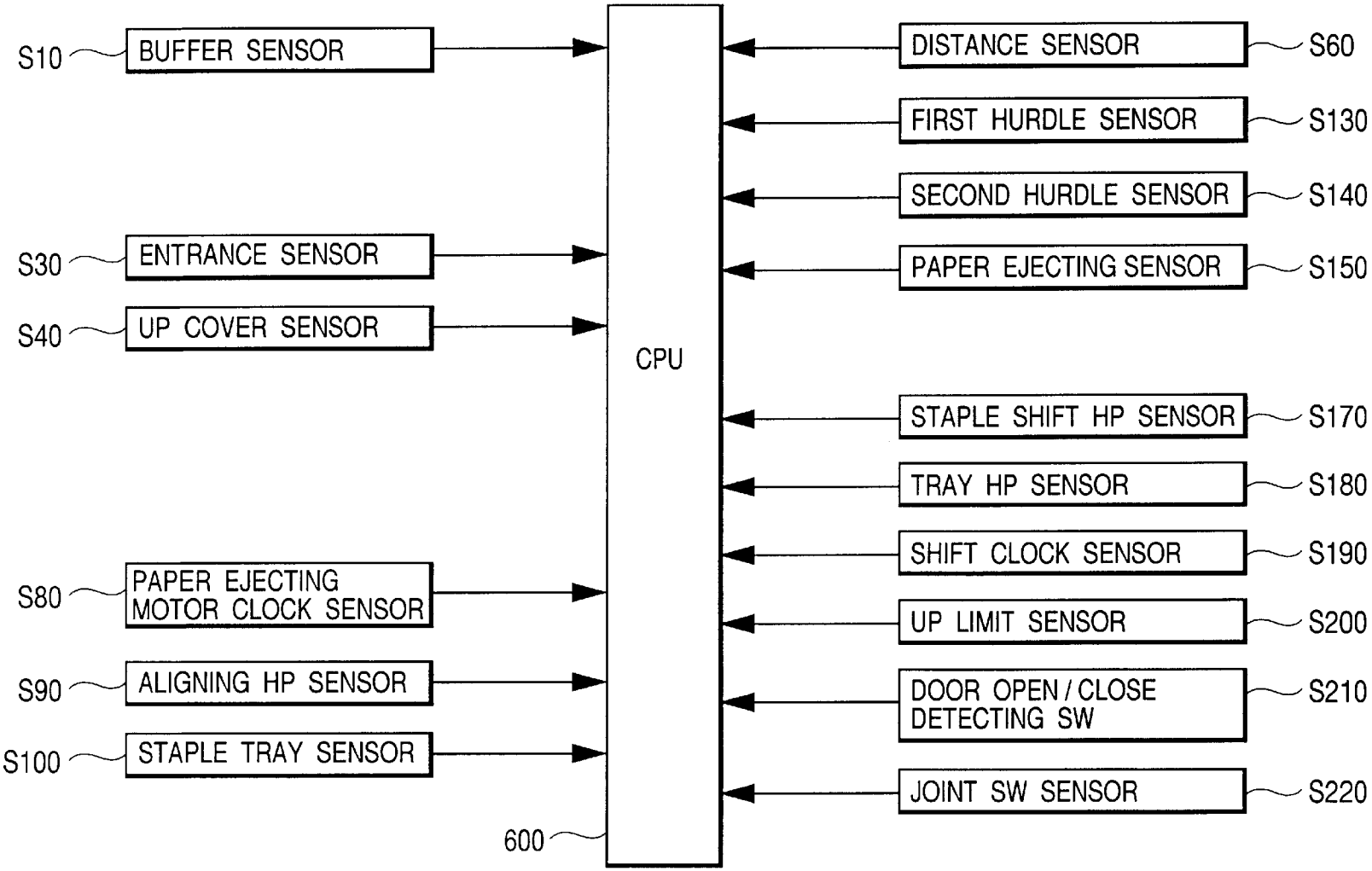
FIG. 12 is a block diagram showing part of a control circuit in the sheet post-processing apparatus.
Figure 13:
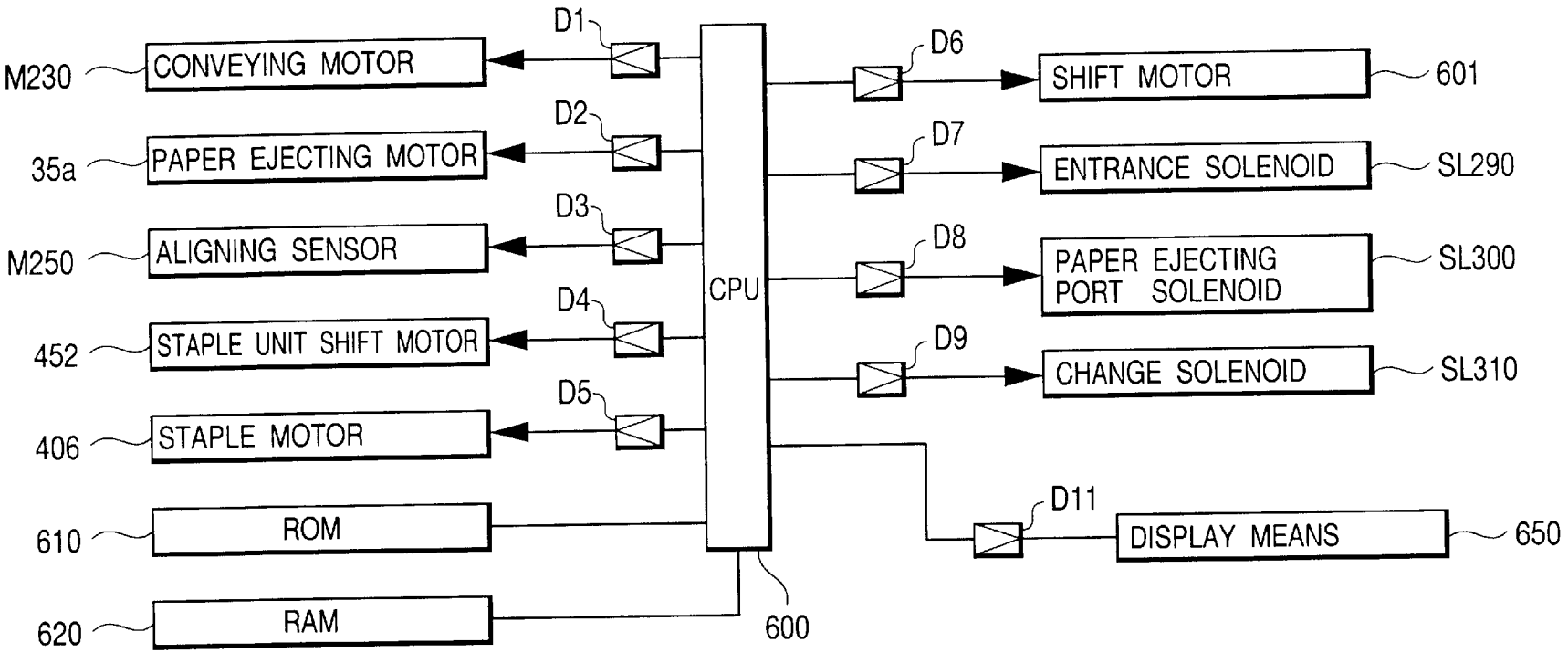
FIG. 13 is a block diagram showing part of the control circuit in the sheet post-processing apparatus.

As described above, the distance sensor 60 is arranged inside the sheet post-processing apparatus 1 and connected to a CPU 600 having a block arrangement shown in FIGS. 12 and 13. Upon reception of a signal from the CPU 600, the distance sensor 60 outputs a trigger signal to the burst wave generating circuit 62 to cause the light-emitting element 61 to emit light and causes the PSD light-receiving element 63 to output to the CPU 600 voltage information corresponding to the light-receiving distance of reflected light.

Figure 14:
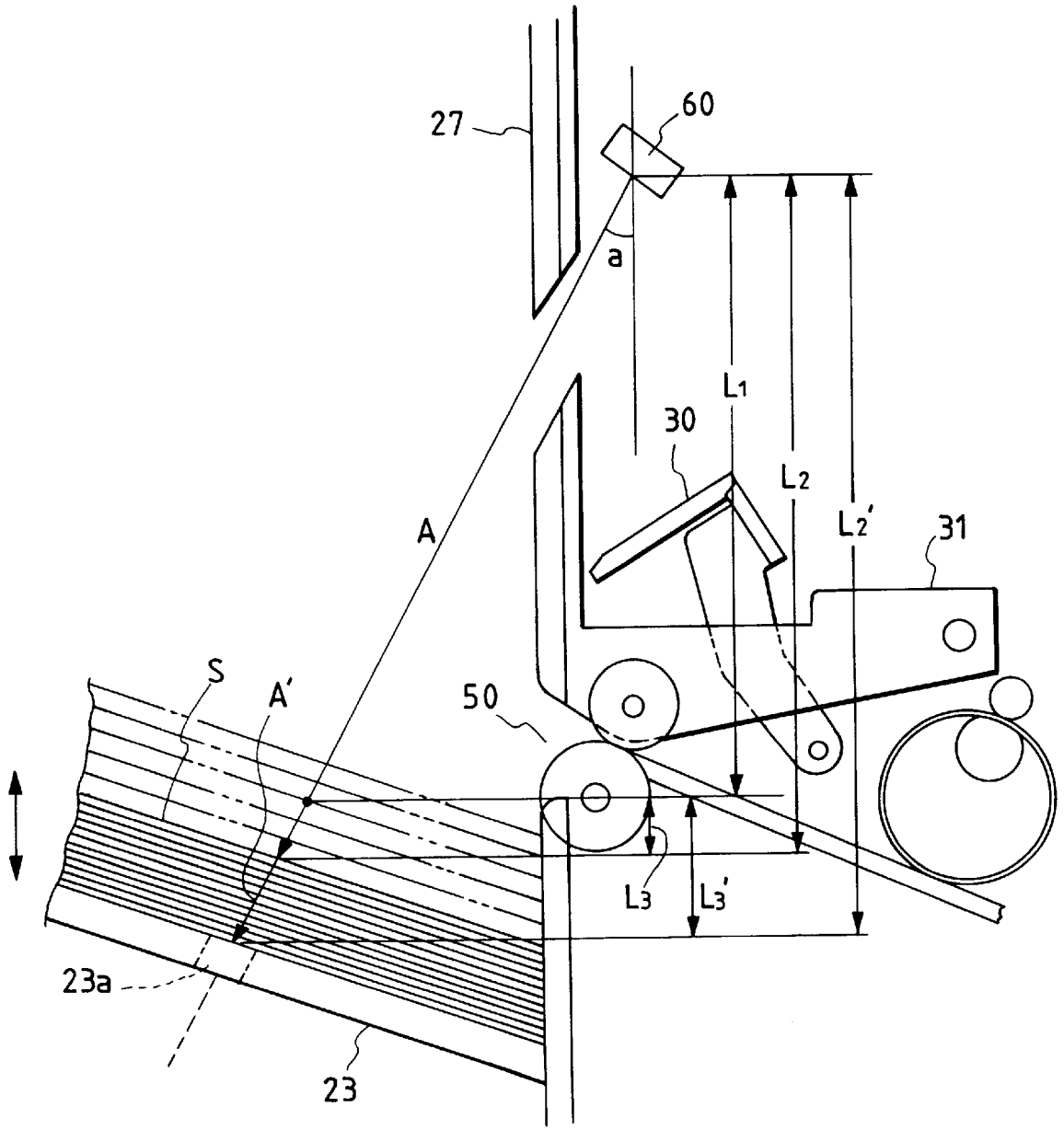
FIG. 14 is a view for explaining the principle of distance measurements of the distance measuring sensor.

As shown in FIG. 14, the distance sensor 60 is arranged obliquely above the tray so as to irradiate light toward the tray 23 (sheet S) at a predetermined angle a, 30° in this embodiment, with respect to the vertical direction.

On the other hand, the CPU 600 obtains a distance A from the distance sensor 60 to the sheet loading surface on the basis of the magnitude of the voltage signal from the distance sensor 60. The CPU 600 may obtain the distance A to the sheet loading surface in accordance with the time difference between emission and light reception in the distance sensor 60. When the distance A to the sheet loading surface is obtained as described above, vertical distances L2 and L2' from the distance sensor 60 to the sheet loading surface can be obtained by equations below. Note that the vertical distance L2' represents the vertical distance when the tray 23 is located at the position where the first sheet is to be loaded, i.e., when no sheet is currently loaded on the tray.

$$L2=A*\cos 30° \quad (1)$$

$$L2'=A*\cos 30° \quad (2)$$

Since the distance L1 from the distance sensor 60 to the ejecting port 50 is known in advance, the distance (L3') from the sheet loading surface of the tray 23 to the ejecting port 50 or the distance (L3) from the upper surface of the uppermost sheet and the ejecting port 50 can be obtained as follows:

$$L3=L2-L1 \quad (3)$$

$$L3'=L2'-L1 \quad (4)$$

Figure 15:
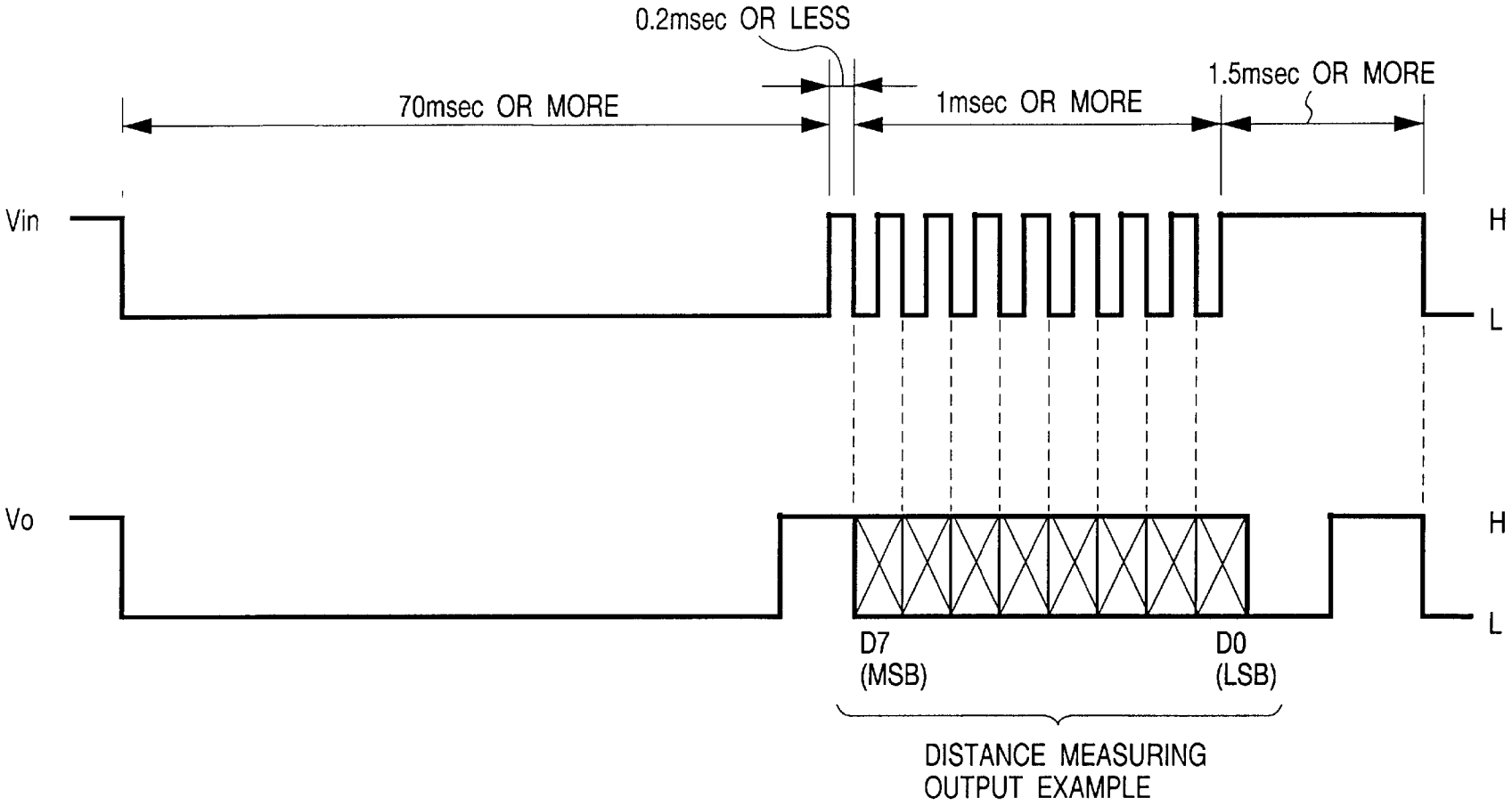
FIG. 15 is a chart showing a signal output from a CPU to the distance measuring sensor and a signal input from the distance measuring sensor to the CPU.

Every time the CPU 600 performs post-processing such as sheet ejection or stapling, this distance measurement is performed by intermittently supplying a signal shown in FIG. 15 to the burst wave generating circuit 62 through the signal processing circuit 64.

Referring to FIG. 15, a signal Vin is used to operate the light-emitting element 61 to emit light, e.g., every staple stroke cycle. When an L (Low) signal having a duration of 70 msec or more continues, the light-emitting element 61 starts light emission to start a measurement. Eight clock pulses each having a duration of 0.2 msec or less are input to the burst wave generating circuit 62 within, e.g., 1 msec or more, thereby measuring distance.

This measurement ends when an H (High) signal having a duration of 1.5 msec or more is input upon input of the eight clock pulses. In response to the signals on the light-emitting side, the PSD light-receiving element 63 converts the received light into a 8-bit voltage signal and outputs this voltage signal to the CPU 600.

On the other hand, in the CPU 600, a table of 8-bit distance data obtained in experiments in advance is formed and stored in a ROM (Read-Only Memory) 610 (FIG. 13)

which stores the control sequence executed by the CPU 600. The CPU 600 obtains the distance A between the distance sensor 60 and the sheet loading surface using data sent from the distance sensor 60 in accordance with this table.

When the obtained distance is shorter than the first predetermined distance representing that sheets are loaded at a predetermined height, e.g., a height which interferes with sheet ejection, the shift motor 601 is driven and controlled through a driver D6 shown in FIG. 13 to shift the tray unit 26 and the tray 23 downward so as not to interfere with sheet ejection.

As described above, when the tray 23 is sequentially shifted downward and reaches the lowest position, and the distance obtained is shorter than the first predetermined distance, it is determined that sheets S in the maximum loading amount are loaded on the tray 23. The tray unit 26 is shifted to load sheets on another tray.

As described above, when the height of the sheets S or the distance between the sheet loading surface of the tray 23 and the ejecting port 50 is measured, the loading amount on the tray 23 and an appropriate shift amount of the tray 23 can be calculated. Note that the calculation results are stored in a RAM (Random Access Memory) 620 for storing a variety of data.

Through holes 23*a*, 24*a*, and 25*a* are formed in the first, second, and third trays 23, 24, and 25 at the measurement points of the distance sensor 60, respectively (see FIGS. 2 and 14). The presence/absence of sheets on the trays 23, 24, and 25 can be determined due to the presence of the through holes 23*a*, 24*a*, and 25*a* in the trays 23, 24, and 25.

More specifically, assume that light is irradiated on the trays 23, 24, and 25. When no sheets are loaded on the trays 23, 24, and 25, the irradiated light passes through the through holes 23*a*, 24*a*, and 25*a* and is reflected upon impinging on the uppermost sheet on the lower tray. With this arrangement, the obtained distance is longer than the second predetermined distance representing that the tray is located at a position where the first sheet is to be loaded. Therefore, the CPU 600 can determine that no sheets are present on the trays 23, 24, and 25.

When no sheets are present on the trays 23, 24, and 25, the CPU 600 determines that the trays 23, 24, and 25 are set in a sheet loading enable state, thereby loading the first sheet on the tray 23, 24, or 25.

As shown in FIG. 12, the input of the CPU 600 is electrically connected to a buffer sensor S10 serving as a means for detecting the presence of sheets in the sheet post-processing apparatus 1, an entrance sensor S30 for detecting that a sheet ejected from the copying apparatus 100 has entered the sheet post-processing apparatus 1, an UP cover sensor S40 for detecting that the upper cover of the sheet post-processing apparatus 1 is opened, a paper ejecting motor clock sensor S80 for causing the CPU 600 to output information concerning an abnormality or speed control of the ejecting motor 35*a* when ejecting sheets from the sheet post-processing apparatus 1 to the trays 23, 24, and 25, an aligning HP sensor S90 for detecting the home position of the abutment plate 20 in stapling, and a staple tray sensor S100, in addition to the distance sensor 60 (S60).

The input of the CPU 600 is also electrically connected to first and second hurdle sensors S130 and S140 for detecting the positions of the upper and lower hurdle guides 27 and 27*a* which form the upper and lower wall surfaces of the ejecting port 50, a paper ejecting sensor S150 for detecting that a sheet has been ejected from the sheet post-processing apparatus 1 to the tray, a staple shift HP sensor S170 for detecting that the stapler 400 capable of shifting in the sheet post-processing apparatus 1 is set at the home position, an UP limit sensor S200 for detecting the upper limit a movable tray, a door open/close detecting switch S210 for detecting opening/closing of the door of the sheet post-processing apparatus 1, and a joint SW sensor S220 for detecting that the sheet post-processing apparatus 1 is kept connected to the copying apparatus 100.

The input of the CPU 600 is further electrically connected to a tray HP sensor S180 and a shift clock sensor S190. As shown in FIG. 5, for example, the tray HP sensor S180 is a sensor for detecting that the tray unit 26 is located at the lowest position. The shift clock sensor S190 is a sensor for counting clocks of the shift motor 601 to measure the shift amount of the tray unit 26.

The CPU 600 can detect the level of the tray unit 26 with respect to the lowest position in accordance with signals from these two sensors S180 and S190. Therefore, the CPU 600 can determine whether the tray has shifted to the home position.

As shown in FIG. 13, the output of the CPU 600 is electrically connected, in addition to the shift motor 601, through drivers D1, D2, D3, D4, D5, D7, D8, D9, and D11 to a conveying motor M23 for conveying a sheet present in the sheet post-processing apparatus 1, the paper ejecting motor 35*a*, an aligning motor M250 for aligning sheets, a staple unit shift motor (pulse motor) 452 for shifting the stapler 400, a staple motor 406 for causing the stapler 400 to bind a bundle of sheets, an entrance solenoid SL290 for changing the conveying path of a sheet ejected from the copying apparatus 100, a paper ejecting port solenoid SL300 for changing the ejecting port of a sheet ejected from the sheet post-processing apparatus 1, a change solenoid SL310 for changing the conveying path of a sheet in the sheet post-processing apparatus 1, and a display means 650 for giving an alarm to an operator when overloading or the like is detected in sheet loading surface distance measurement.

Figure 16:
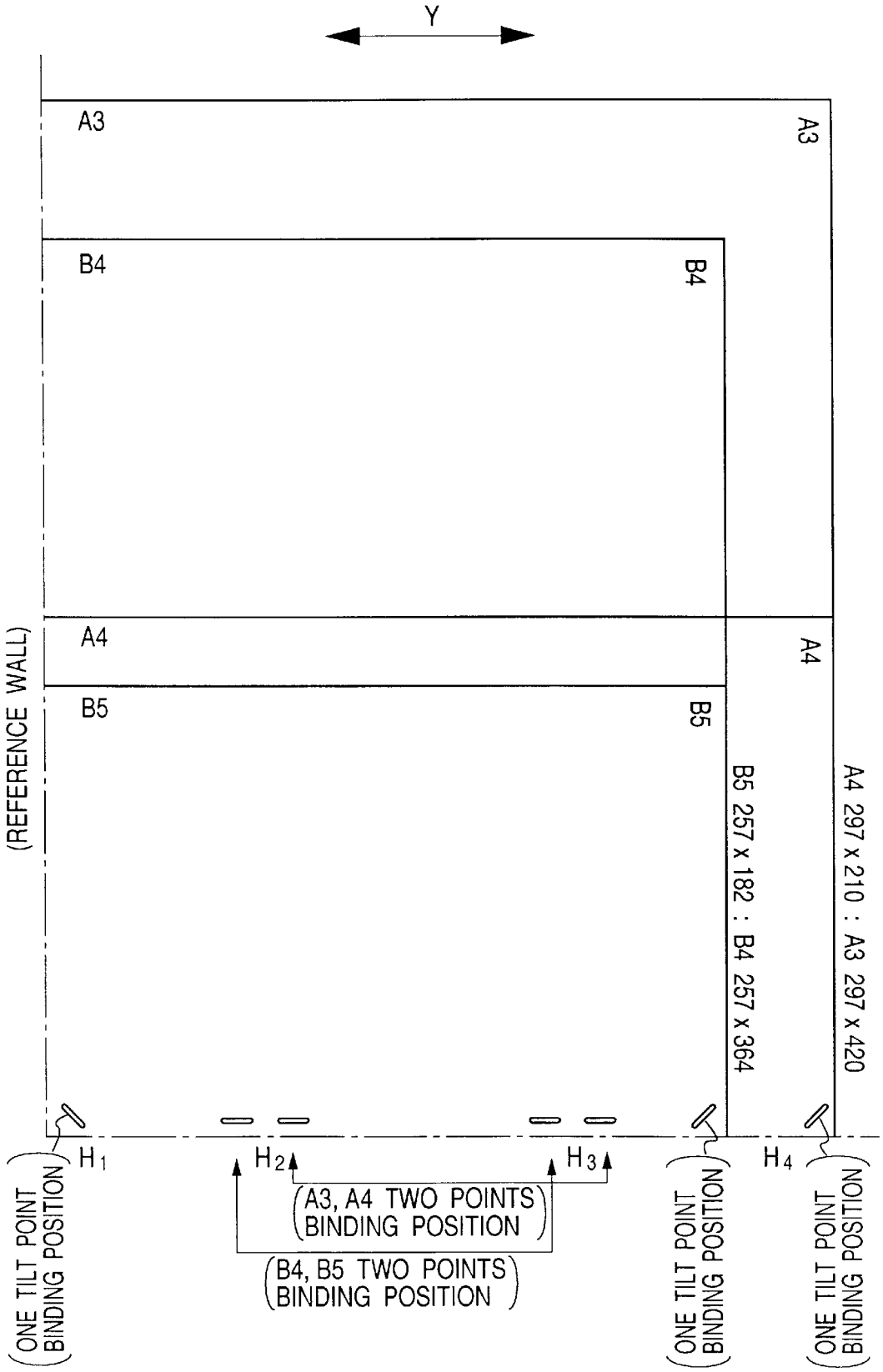
FIG. 16 is a view for explaining the binding positions of a stapler unit.

A staple unit 400A has the stapler 400 for binding a bundle of sheets loaded on a staple tray 38 in the staple process, as shown in FIG. 2. The staple unit 400A is operated by a pulse motor (to be described later) in the direction of an arrow Y in FIG. 16 to perform front one-point binding (binding position H1), two points binding (binding positions H2 and H3), or rear one point binding (binding position H4) for sheets loaded on the staple tray 38. In FIG. 16, the sheet sizes are A3, A4, B4, and B5 sizes. However, the present invention is not limited to the specific sheet sizes.

Figure 17:
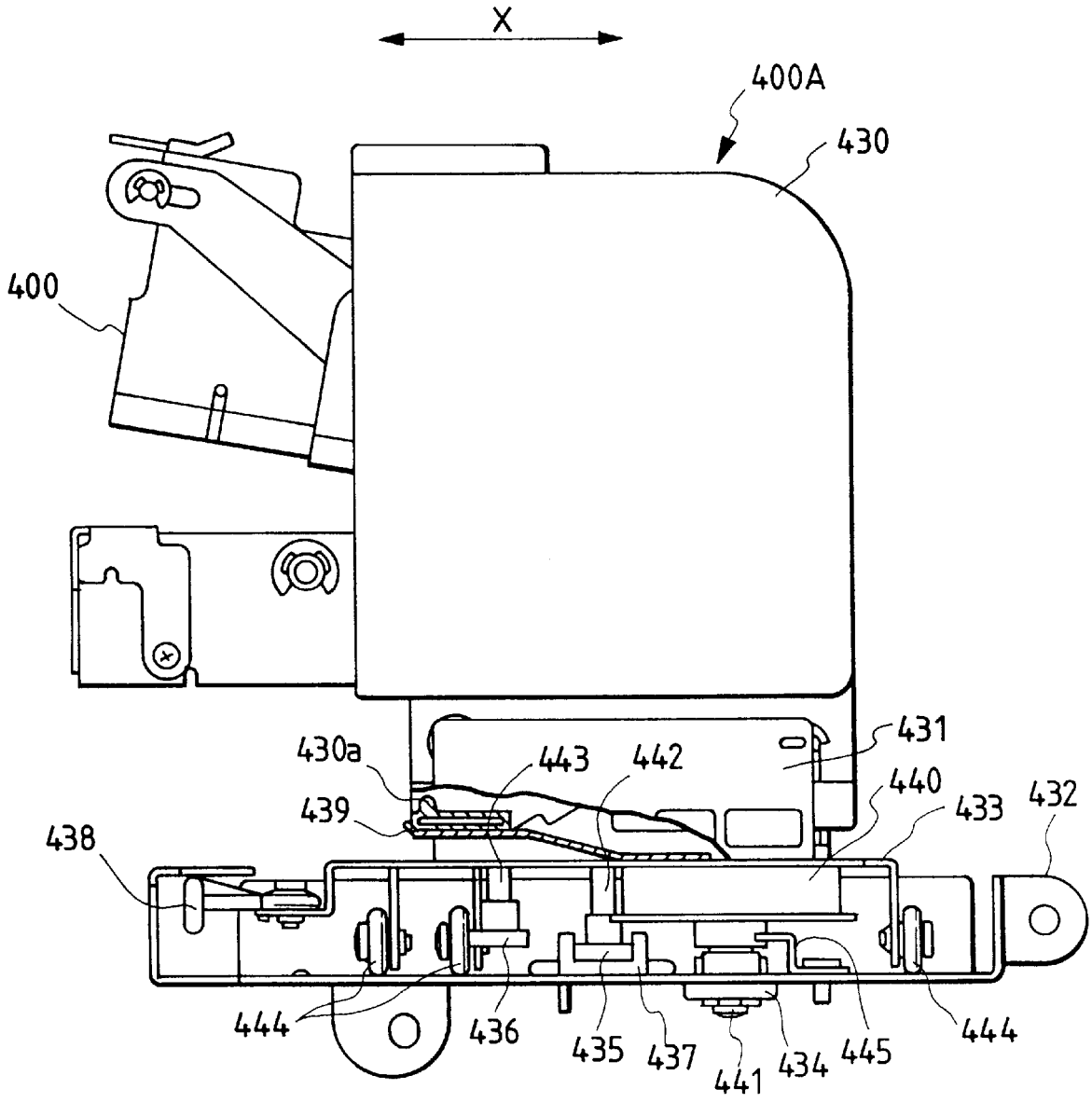
FIG. 17 is a partially cutaway side view of the stapler unit.

The stapler 400 is fixed to a stapler cover 430, as shown in FIG. 17, and movably supported in the X direction by a support member 431 fixed on a shift base 433.

A spring member 439 is fixed to the shift base 433 and biases the stapler cover 430 upward. A stopper 430*a* positions the stapler cover 430.

Shafts 441, 442, and 443 are fixed to the shift base 433. A pulley gear 440 and a leading support member 434 are rotatably supported on the support shaft 441. The support shaft 442 rotatably supports a leading support member 435. The support shaft 443 rotatably supports a leading support member 436. Rollers 444 for maintaining a parallel shift of the shift base 433 are rotatably supported on the shift base 433. A stopper regulating member 438 constituting a retracting means (to be described later) of the abutment plate 20 is fixed to the shift base 433.

Figure 18:
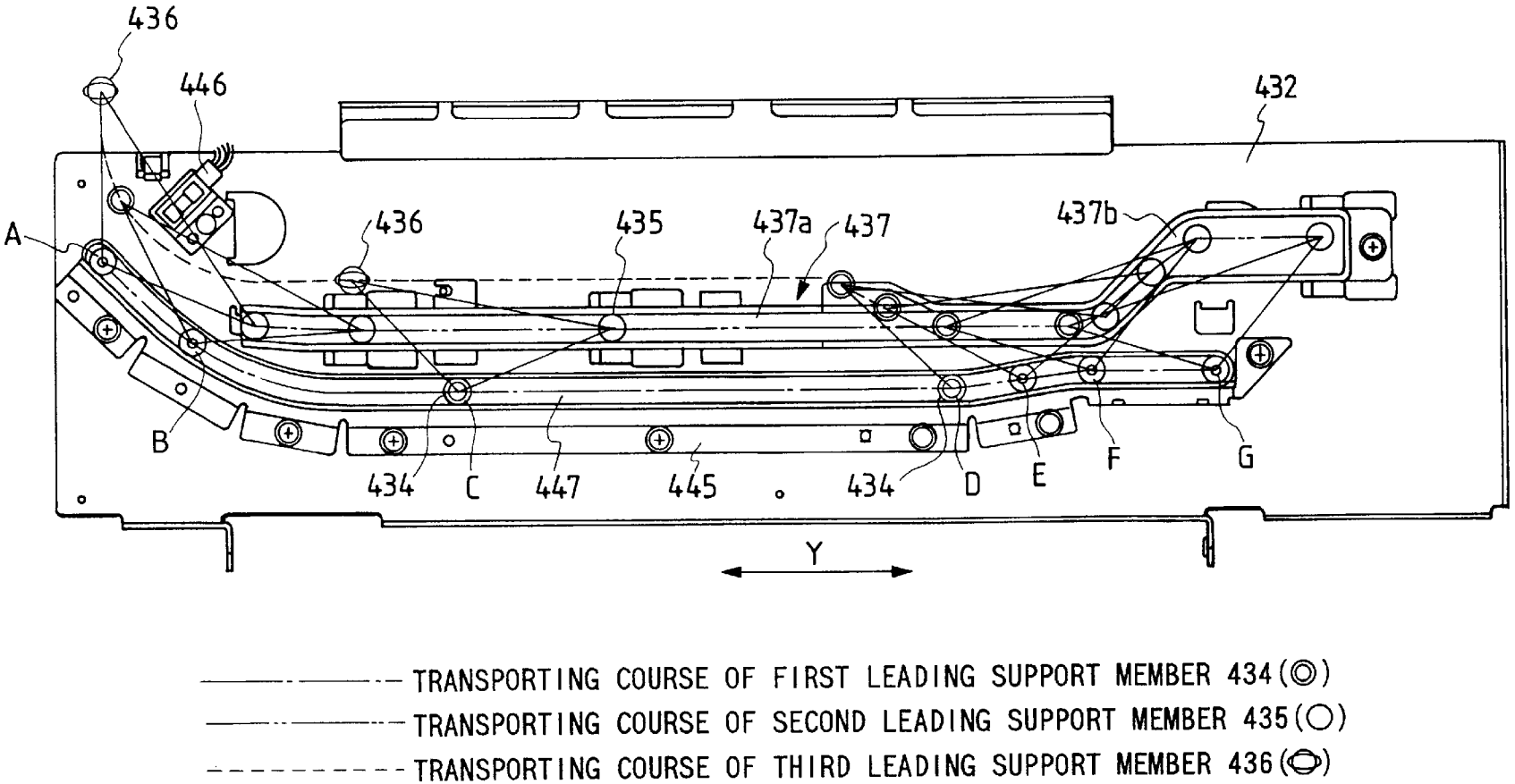
FIG. 18 is a perspective view illustrating the transporting course of the stapler unit.

On the other hand, an elongated groove 447 for regulating the shift of the first leading support member 434 is formed in a stay 432 disposed opposing the staple tray 38, as show in FIG. 18. A rail 437 for regulating the shift of the second and third leading support members 435 and 436 and a rack gear 445 meshing with the pulley gear 440 are fixed to the stay 432.

Referring to FIG. 18, a photointerrupter 446 detects whether the staple unit 400A is located at the home position (when the first leading support member 434 is located at point A in FIG. 18). In this embodiment, the rotation amount of a pulse motor (to be described later) is defined by the number of pulses with reference to the home position, using the photointerrupter 446, thereby controlling the binding position of the staple unit 400A. The scope of the present invention is not limited to this.

Figure 19:
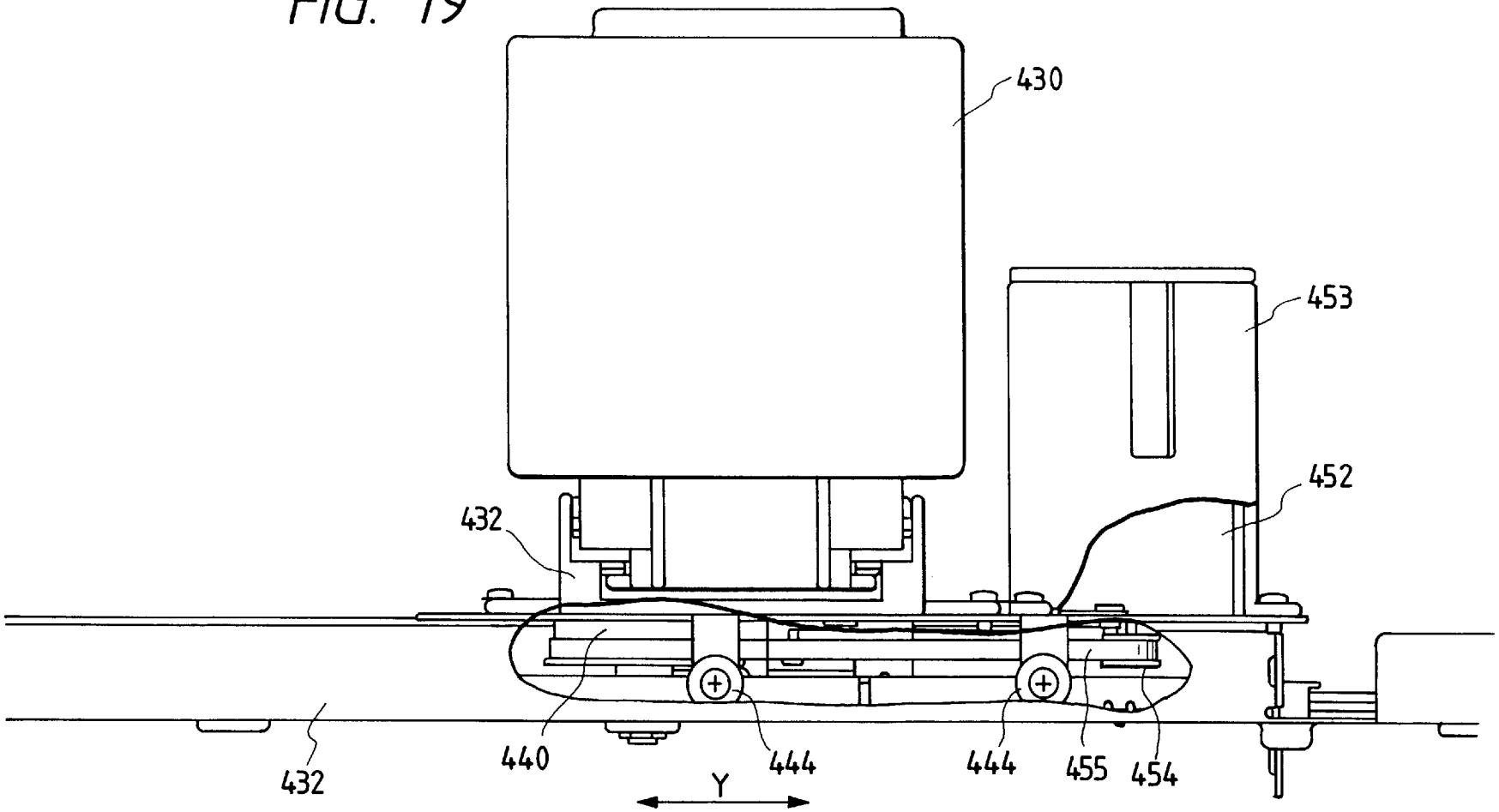
FIG. 19 is a partially cutaway right side view of the stapler unit.

As shown in FIG. 19, the pulse motor 452 for shifting the staple unit 400A in the direction of an arrow Y is fixed on the shift base 433. A belt pulley 454 is fixed to the pulse motor 452. The belt pulley 454 is coupled to the pulley gear 440 through a timing belt 455 to transmit rotation of the motor 452 to the pulley gear 440 through the belt pulley 454 and the timing belt 455, thereby shifting the staple unit 400A in the direction of the arrow Y. A cover 453 covers electric components such as the pulse motor 452.

During the shift of the staple unit 400A, the first leading support member 434 shifts between A and G (FIG. 18) along the elongated groove 447 formed in the stay 432, the second leading support member 435 shifts along the rail 437 during the shift of the first leading support member 434 between A and E, and the third leading support member 436 shifts along the rail 437 while the first leading support member 434 shifts between E and G.

For example, when the first leading support member 434 is located at position A in FIG. 18, the position of the second leading support member 435 is regulated by the rail 437, and the third leading support member 436 is set in a free state. In this case, a tilt point binding operation can be performed at position H1 in FIG. 16. When the first leading support member 434 shifts from position A to position C, the staple unit 400A kept at position A in a state inclined at a predetermined angle gradually pivots to be parallel with the widthwise direction of the sheet upon shifting of the second leading support member 435 along the rail 437. When the first leading support member 434 shifts between C and D, the position of the staple unit 400A is maintained to be parallel with the widthwise direction of the sheet. Therefore, two points parallel binding (H2·H3) can be performed in accordance a variety of sheet sizes.

The staple unit 400A is arranged to be movable in the Y direction while its position and angle are always regulated by two of the three leading support members 434, 435, and 436, and one or two points binding on the front side can be performed at positions corresponding to a variety of sheet sizes. The shift amount of the first leading support member 434 is defined by the rotation amount of the pulse motor 452, as described above.

In this embodiment, as shown in FIG. 3, the aligning reference plate 29 is disposed on one side, so that the front one-point binding position (H1) is common to a variety of sheet sizes. However, the sheet aligning reference may be changed to the sheet center, and the two points binding positions (H2 and H3) may be set common to a variety of sheet sizes.

Figure 20:
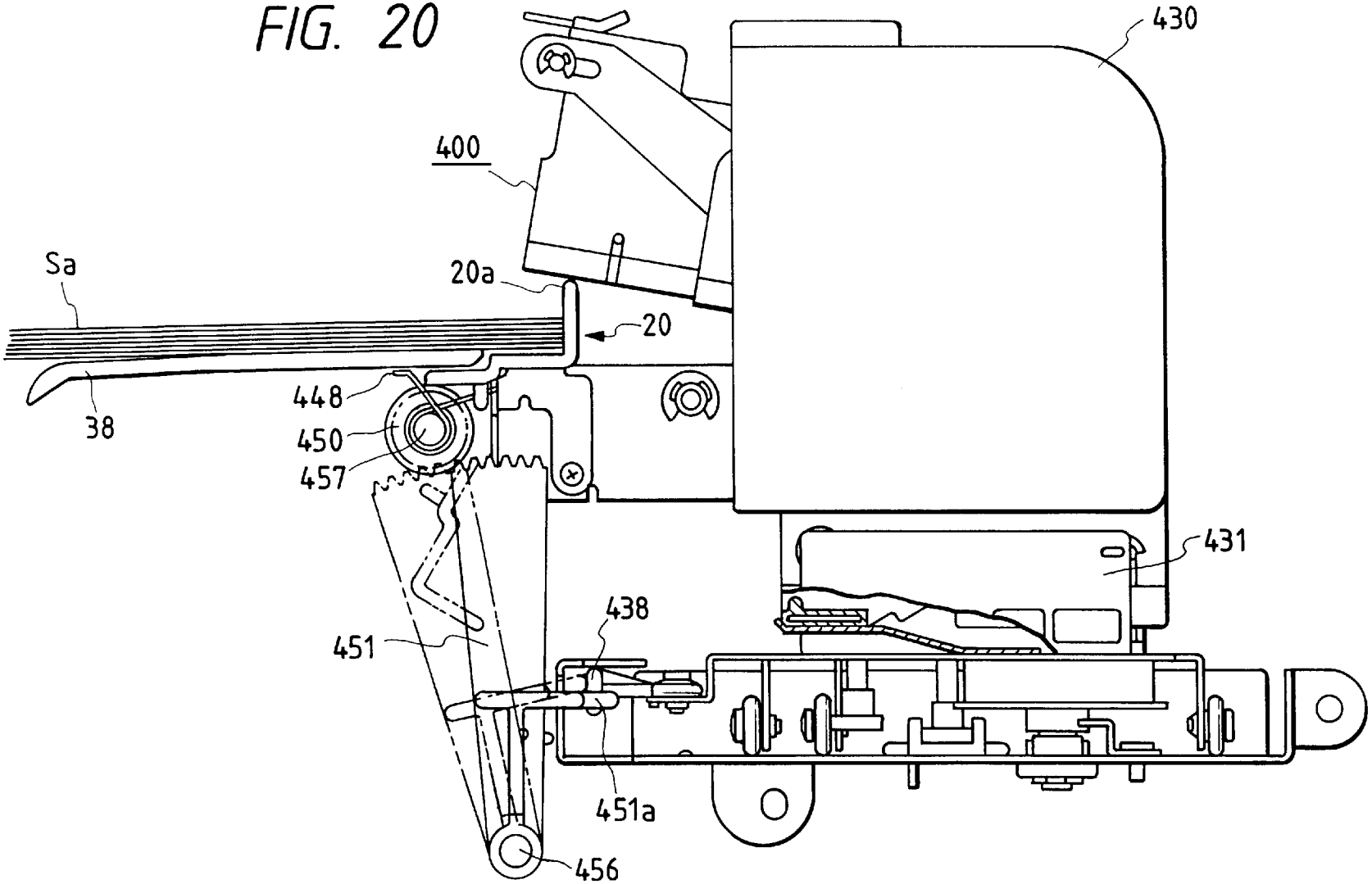
FIG. 20 is a side view showing the operation of a retracting means in the stapler unit.

To perform such a binding operation, a regulating member that is brought into contact with the trailing ends of a bundle of sheets to align them is required. For this purpose, the abutment plate 20 is disposed at the rear end of the staple tray 38, as shown in FIG. 20.

The abutment plate 20 is rotatably held on a shaft member 457 fixed to the staple tray 38 and is biased counterclockwise by a spring member 448 wound on the shaft member 457. A regulating portion 20*a* formed at one end portion of the abutment plate 20 projects upward from the rear end of the staple tray 38. In this state, when sheets are loaded on the staple tray 38, the trailing ends of the sheets contact the abutment plate 20. Therefore, the trailing ends of a bundle Sa of sheets are aligned with each other.

Since the abutment plate 20 and the stapler 400 overlap each other, when the staple unit 400A is to be moved or a staple process is to be performed, the abutment plate 20 becomes an obstacle. For this reason, the abutment plate 20 has a retracting means 449 for retracting the abutment plate 20 to a position where the abutment plate 20 does not interfere with the shift of the staple unit 400A when shifting the staple unit 400A.

The retracting means 449 is fixed to the abutment plate 20. The retracting means 449 comprises a gear portion 450 attached to the shaft member 457, a pivotal sector gear 451 having an axially supported lower end and meshing with the gear portion 450 of the abutment plate 20, and the stopper regulating member 438 which is fixed on the shift base 443 and comes into contact with the sector gear 451 to pivot the sector gear 451 about a shaft portion 456 in shifting the staple unit 400A.

The sector gear 451 has an abutment portion 451*a*. In shifting the staple unit 400A, the stopper regulating member 438 comes into contact with this abutment portion 451*a*. When the stopper regulating member 438 contacts the abutment portion 451*a*, the sector gear 451 is pushed in a direction perpendicular to the shift direction of the staple unit 400A and pivots to a position indicated by a broken line.

When the sector gear 45 pivots in this manner, the gear portion 450 meshing with the sector gear 451 rotates. Accordingly, the abutment plate 20 pivots downward about the shaft member 457 to the retraction position where the abutment plate 20 does not interfere with the shift of the staple unit 400A below the staple tray 38.

When the staple unit 400A shifts further, the stopper regulating member 438 is released from the abutment portion 451*a* of the sector gear 451. The abutment plate 20 returns together with the sector gear 451 by the return force of the spring member to the position where the trailing ends of a bundle Sa of sheets are regulated, as shown in FIG. 20.

Figure 21:
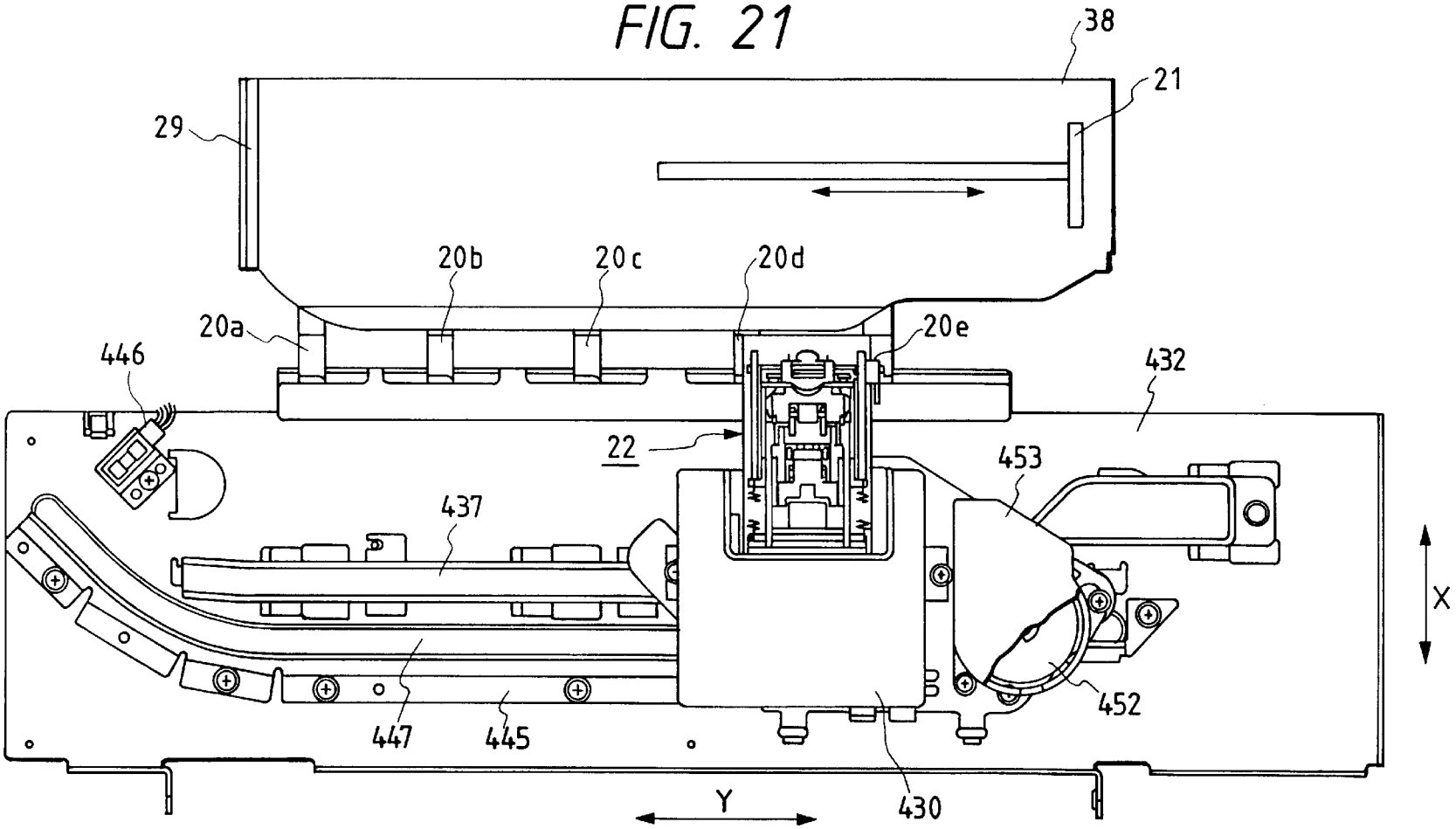
FIG. 21 is a plan view showing the operation of the stapler unit and an abutment plate.

As shown in FIG. 21, a plurality of abutment plates 20 are disposed in the widthwise direction of the sheet. These abutment plates 20*a*, 20*b*, 20*c*, 20*d*, and 20*e* each have retracting means 449. The abutment plates 20*a*, 20*b*, 20*c*, 20*d*, and 20*e* are arranged to be pivotal independently of each other.

The three abutment plates 20*a*, 20*b*, and 20*c* are located at positions to align the trailing ends of the bundle of sheets, while the remaining two abutment plates 20*d* and 20*e* are located at positions not to interfere with the shift of the staple unit 400A, so as to correspond to the position of the staple unit 400A.

Figure 22:
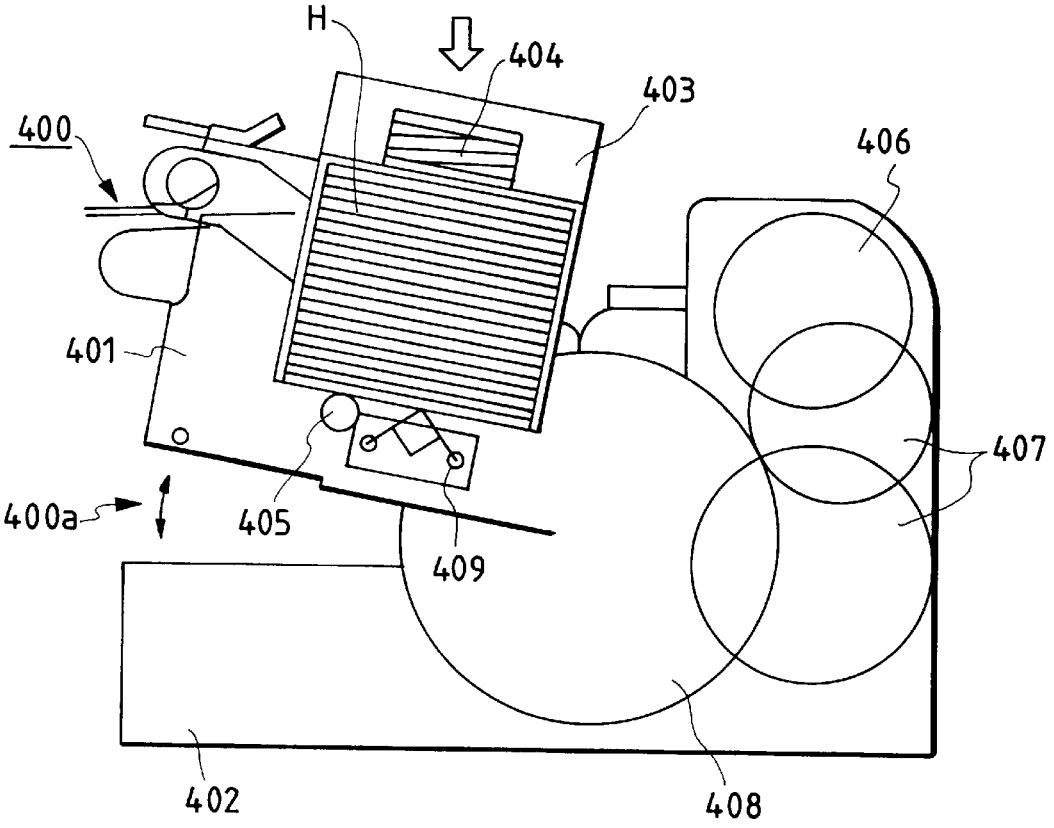
FIG. 22 is a view illustrating the structure of a stapler in the stapler unit.

The detailed structure and the basic operation of the stapler 400 will be described below. The stapler 400 has an alligator shape, as shown in FIG. 22. The stapler 400 has a staple stroke unit 400*a* constituted by an upper forming portion 401 and a lower staple table 402. A staple cartridge 403 is detachably mounted in the forming portion 401. About 5,000 staples H coupled into the form of a plate are loaded in the staple cartridge 403.

The staples H loaded in the staple cartridge 403 are biased downward by a spring 404 disposed on the uppermost side of the staple cartridge 403 to apply a conveying force to a feeding roller 405 located on the lowermost side. The staple H fed out by the feeding roller 405 is formed into a U shape one by one by swinging the forming portion 401.

When the staple motor 406 is activated, an eccentric cam gear 408 rotates through a gear train 407, and the forming portion 401 swings to the staple table 402 side, as indicated by an arrow, by the action of an eccentric cam mounted together with the eccentric cam gear 408, thereby performing a clinching operation (binding operation).

A reflection sensor 409 is arranged in the stapler 400 below the staple cartridge 403 to detect the absence of the staples H loaded in the staple cartridge 403. In this embodiment, the reflection sensor 409 detects jamming of the staple H fed out from the staple cartridge 403.

Figure 23:
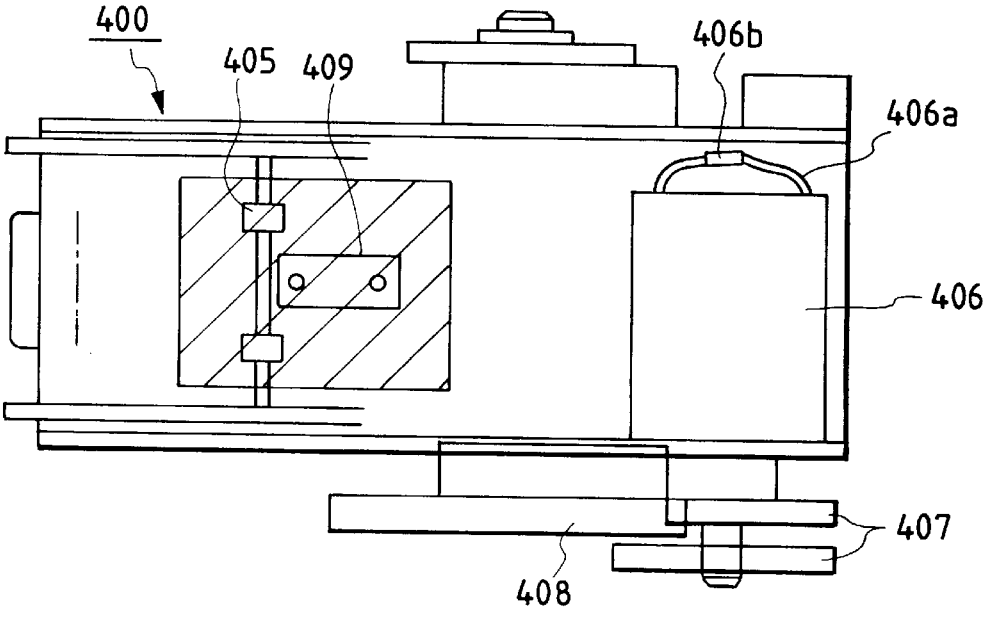
FIG. 23 is a plan view of the stapler.

Staple jam detection of the staple H will be described below. FIG. 23 is a plan view of the stapler 400. A cord 406*a* for flowing a driving current to the staple motor 406 is connected to the staple motor 406. A current sensor (abnormality detecting means) 406*b* serving as a load detecting means for detecting the current value is attached to this cord 406*a*.

Figure 24:
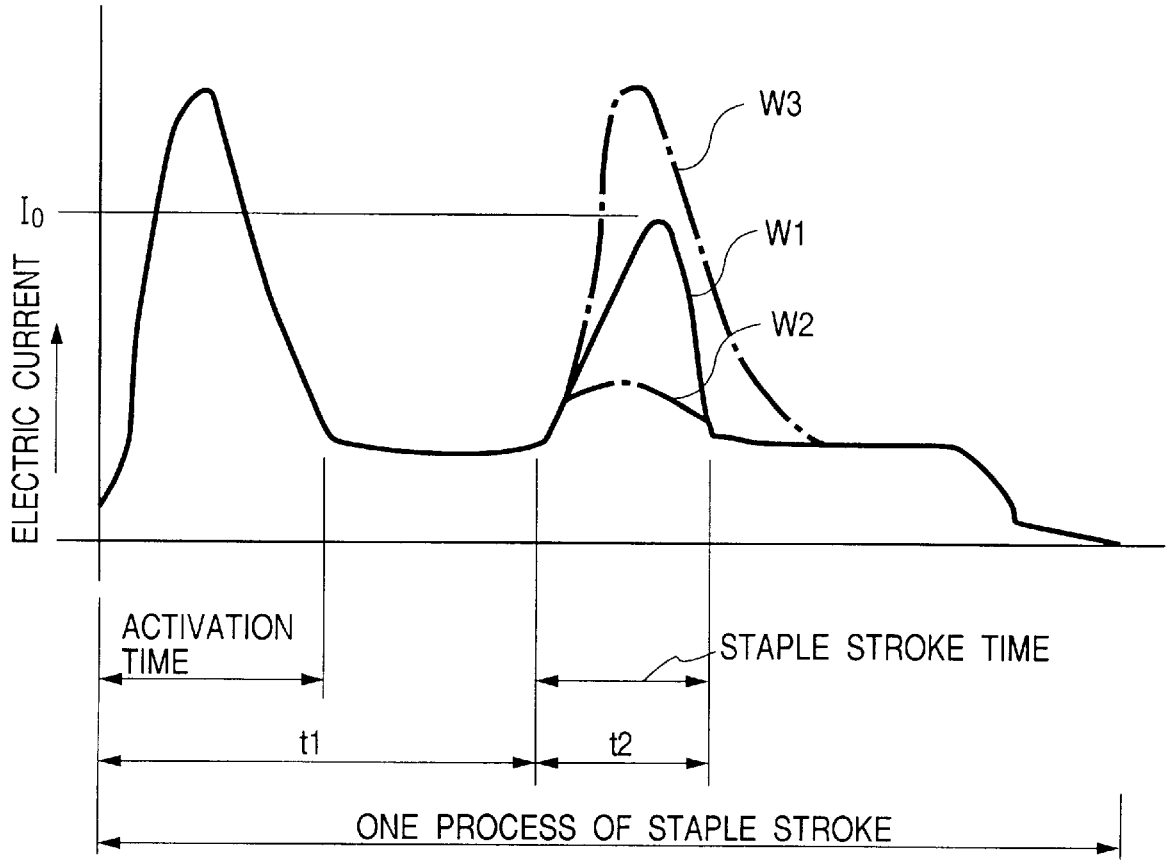
FIG. 24 is a waveform chart showing a current value that flows through a staple motor in the staple stroke using the stapler.

On the other hand, FIG. 24 shows the waveform of a current value flowing in the staple motor 406 in one process of staple stroke, which value is detected by a current sensor 406*b*. Referring to FIG. 24, a waveform W1 represents a waveform obtained when a staple H is normally fed out, pierces the bundle Sa of sheets, and is bent. A waveform W2 represents a waveform obtained when pre-stapling (no staple H is fed out although the stapler 400 is operated) is performed. In pre-stapling, since there are no loads generated when the staple H pierces the bundle Sa of sheets and is bent the current level lowers.

A waveform W3 is a waveform generated when a staple stroke error or a staple jam has occurred. In this case, an overload is generally produced to extremely increase the current level. A normal staple stroke is determined when the current level is about an $I_0$ value (initial set value). If $I>I_0+C$ (C is a variation), it may be determined that a staple jam, a staple stroke error, an abnormality of the stapler mechanism, or the like has occurred. If $I<I_0-C$, pre-stapling is determined. Note that the user is notified of a staple absence state or a staple jam state in the stapler 400 through a display unit using an LED or the like.

The staple operation of the stapler 400 having the above structure will be described below.

Figure 25:
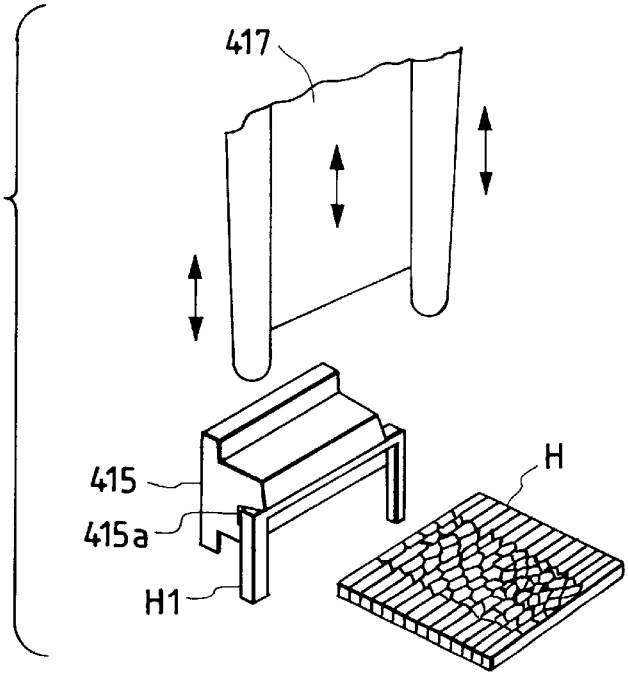
FIG. 25 is a perspective view showing a state in which the central portion of the frontmost staple is held in a staple bending block.

The staples H in the form of a plate, which are stored in the staple cartridge 403 are fed out from the lowermost staple one by one by the feeding roller 405. The fed staple is supplied to a staple bending block 415, as shown in FIG. 25. The central portion of the leading staple H2 is held in a holding groove 415*a*.

Figure 26:
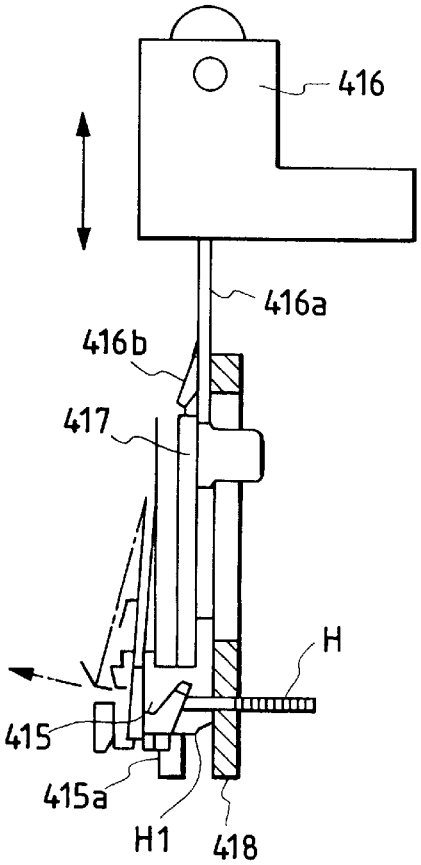
FIG. 26 is a side view showing the staple stroke process of a forming unit in the stapler.

The eccentric cam gear 408 then rotates to shift the forming portion 401 to the lower operation position. A driver 416 is pressed downward by a driving mechanism (not shown), as shown in FIG. 26, so that a plunger 416*a* is pressed downward. At this time, a U-shaped binding block 417 is pressed by a press pawl 416*a* formed at part of the plunger 416*a*. The staple H held in the holding groove 415*a* of the staple bending block 415 is bent in a U shape, as shown in FIG. 25.

The plunger 416*a* is further pressed, and the press pawl 416*b* is released from the U-shaped bending block 417. Only the plunger 416*a* is further pressed downward and reaches the taper portion of the staple bending block 415. The plunger 416*a* cuts only the frontmost staple H1 being in the U shape with a staple cutting member 418 while removing the staple bending block 415 to a position indicated by the alternate long and short dashed line in FIG. 26. The plunger 416*a* further presses the cut staple H1 on the staple table 402 side, thereby binding the sheets S.

Thereafter, when the eccentric cam gear 408 continues to rotate and the forming portion 401 comes to the upper standby position, the driver 416 and the plunger 416*a* move upward and return to the standby position, thereby completing one process of staple operation.

The sheet post-processing operation of the sheet post-processing apparatus having this staple unit 400A will be described below.

Figure 27:
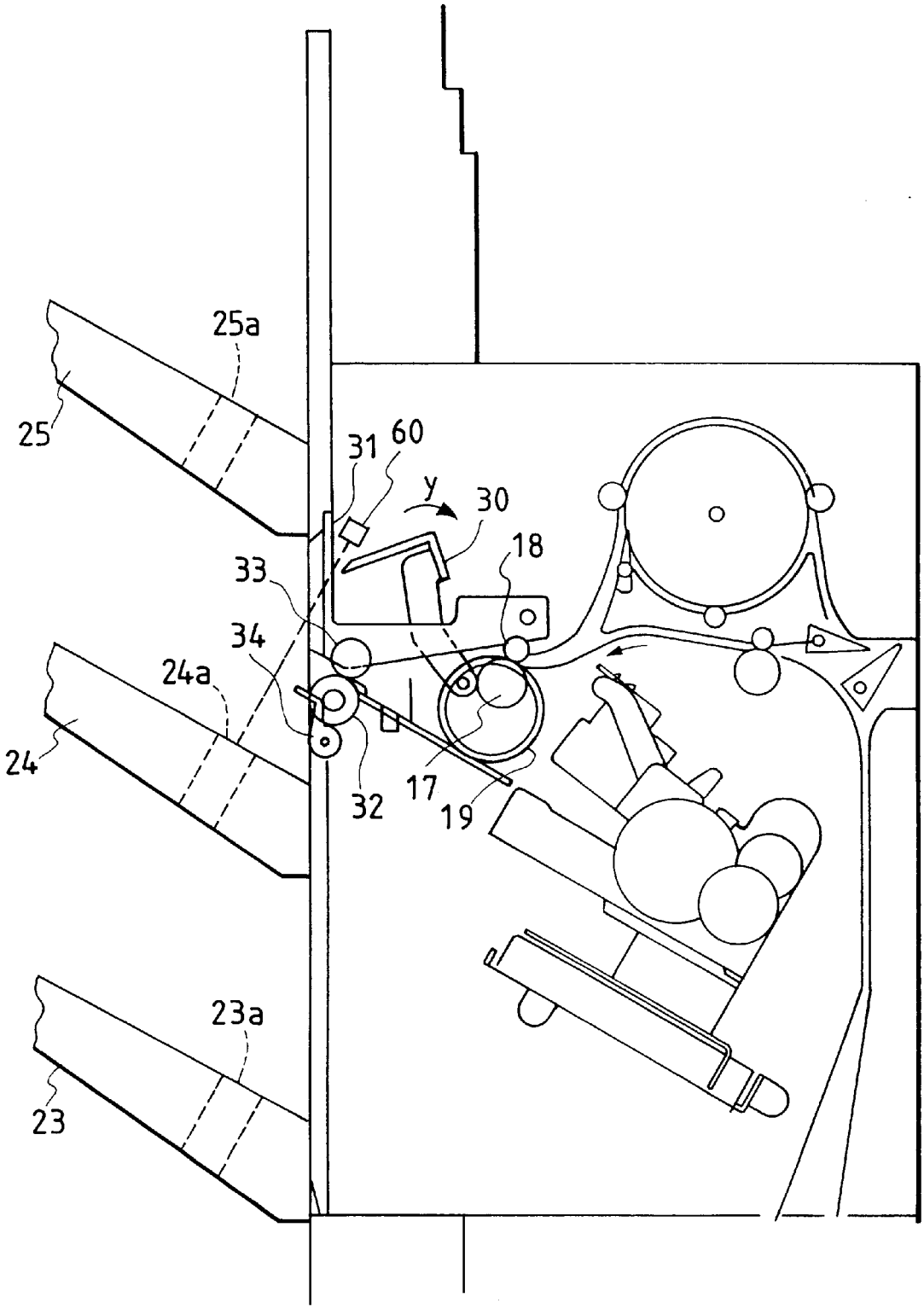
FIG. 27 is a side view showing a state in which a sheet is ejected to the second tray in the sheet post-processing apparatus.

For example, to eject sheets without being stapled, the sheets are directly ejected to the first, second, and third trays 23, 24, and 25. That is, sheet ejecting control 1 (to be described later) is performed. FIG. 27 shows a case in which copy sheets are to be ejected to the second tray 24.

Figure 7:
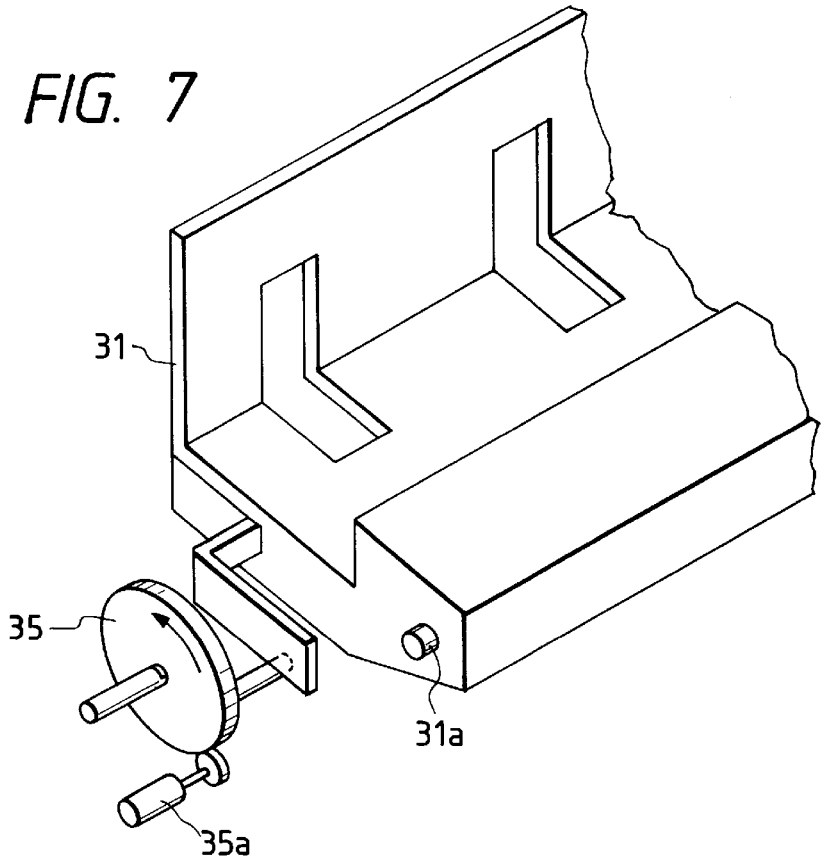
FIG. 7 is a perspective view showing a state in which a swinging guide in the sheet post-processing apparatus swings.

When the user selects the non-sort mode, the cam 35 shown in FIG. 7 is rotated by the paper ejecting motor 35*a* in the direction of an arrow, and the swinging guide 31 swings about the swinging shaft 31*a* as the fulcrum to a position where the ejecting rollers 32 and 33 are brought into tight contact with each other, as shown in FIG. 6. Note that the stopper 30 for closing the ejecting port 50 rests at a position where it is pivoted in the direction of the arrow with respect to the swinging guide 31.

In this state, a sheet ejected from the copying apparatus 100 passes through the conveying path 6 (FIG. 2) constituting part of the conveying means and is transferred to the pair of rollers 5 and 17. The sheet is then ejected downstream of the pair of rollers 5 and 17. The sheet is then directed toward the tray 24 by the swinging guide 31. The sheet is ejected from the ejecting port 50 through the ejecting rollers 32 and 33. In this manner, the sheets are sequentially loaded on the tray 24.

On the other hand, to load and store a large number of regular sheets S, the absence of sheets on the second tray 24 is checked by the distance sensor 60 shown in FIG. 27. The CPU 600 causes the distance sensor 60 to irradiate light toward the second tray 24 and measures the time the reflected light is received. In this case, since the measured time is longer than the second predetermined time, the CPU 600 determines the absence of sheets on the tray 24.

After it is checked that no sheet is left on the tray 24, the tray 24 is shifted to the position where the first sheet is to be loaded, so as to load sheets from the current tray height.

When the number of sheets loaded on the tray reaches a predetermined number, the tray unit 26 is lowered to a position where the upper surface of the uppermost one of sheets loaded on the tray becomes almost even with the surface which has received the first sheet. The above operation is repeated. When it is detected that sheets are loaded on the tray in a maximum loading amount, a stop signal is output to the copying apparatus 100 to temporarily stop ejecting the sheets.

To subsequently load sheets on the third tray 25, the tray unit 26 is lowered to a predetermined position where the first sheet is to be loaded on the third tray 25. A copy operation is started again in the copying apparatus 100, and sheet loading is stopped again. The same operation as described above is repeated until the tray 25 is full of sheets. Note that this also applies to a case in which sheets are loaded on the first tray 23 and a case in which sheets are transferred from the second tray 24 to the third tray 25.

In this embodiment, the copying apparatus 100 employs the digital scheme, as previously described. The copying apparatus 100 can read the image of an original sent from the ADF 300 or an original placed on the original glass table 101 and copy this image, and can be used as a facsimile apparatus or the printer of a personal computer through the interface 500.

To use the copying apparatus 100 in this manner, sheets must be classified and loaded into trays, or loaded on a desired one of trays the number of which is designated by the user, as needed.

For this purpose, in this embodiment, for example, the first tray 23 loads output sheets from the facsimile apparatus, the second tray 24 loads output sheets from the personal computer, and the third tray 25 loads output sheets in the copy mode. Ejection of sheets to these trays in this manner will be described below.

Figure 28:
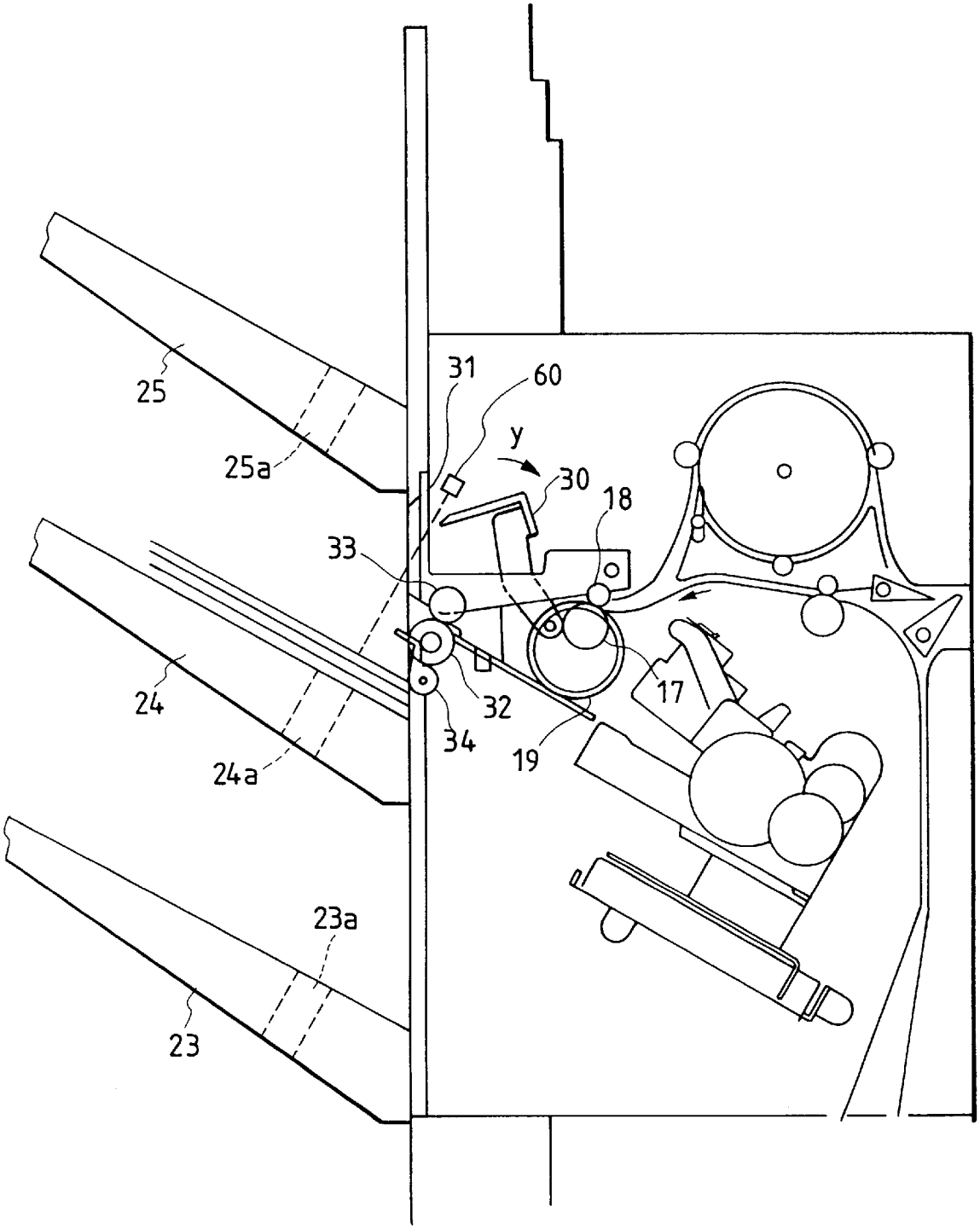
FIG. 28 is a side view showing a state in which a sheet has been ejected to the second tray in the sheet post-processing apparatus.

Loading of copy-mode sheets from a state in which several output sheets are received from the personal computer to the second tray 24 shown in FIG. 28, i.e., loading of sheets to the third tray 25 will be described below.

In this case, when the power supply of the sheet post-processing apparatus 1 is turned on, the I/O ports and the memory (RAM) are initialized, and a mode of communication with a FAX or copying machine is set. To load sheets to the third tray 25 in a state wherein several output sheets from the personal computer are received by the second tray 24, the tray unit 26 is lowered and located at the position where the third tray 25 is to receive the first sheet. This operation is identical to that described above in the copy mode except that the tray unit 26 is lowered even if the number of sheets on the tray is not the maximum loading amount.

Loading of output sheets from the facsimile apparatus in a state wherein several output sheets are received from the personal computer to the second tray 24, i.e., loading of sheets to the first tray 23 will be described below.

In this case, the tray unit 26 is operated upward to load sheets on the first tray 23 while the sheets are kept loaded on the second tray 24. The stopper 30 is pivoted about the pivot shaft 30*a* as a fulcrum from a position indicated by the broken line to a position indicated by the solid line in FIG. 8 so as not to guide the sheet S into a space F indicated by hatched lines in FIG. 6. In this manner, the space F is closed, so that the tray 24 can be operated upward while loading the sheets S.

The tray on which the sheets S are loaded crosses the ejecting port 50, so that the performance of the copying apparatus 100 having the interface can be sufficiently enhanced.

The staple operation of the sheet post-processing apparatus will be described below.

In the staple sort mode in which a copy is obtained upon stapling, sheets are not directly loaded on the trays 23, 24, and 25, but are loaded on the staple tray 38 shown in FIG. 2.

When the staple sort mode is selected by the user, the swinging guide 31 swings upward so as to open the ejecting port 50 and separate the ejecting rollers 32 and 33, as shown in FIG. 9. When the swinging guide 31 swings in this manner, the roller guide 34 is held by the spring 37 flush with the lower hurdle guide 27*a*, and the sheet stopper 30 projects above the bundle Sa of sheets loaded on the tray 24.

Figure 29:
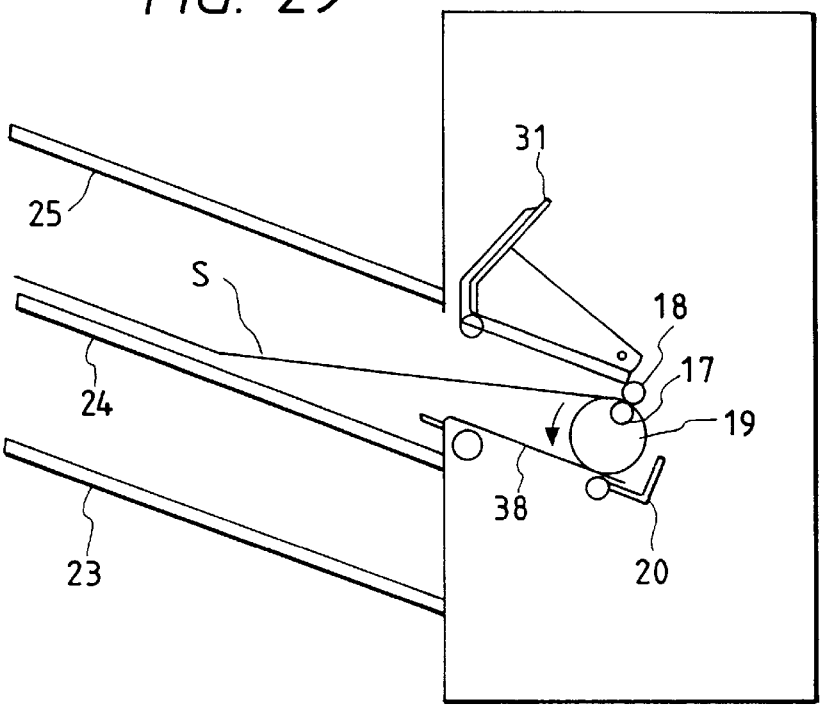
FIG. 29 is a side view showing a state of the second tray in the staple sort mode.

In this state, a sheet ejected from the copying apparatus 100 passes through the conveying path 6 and is transferred to the pair of rollers 17 and 18 and ejected from the pair of rollers 17 and 18. Since the swinging guide 31 has swung to the upper position, the sheet is not ejected but loaded on the staple tray 38. In this case, the tray 24 is located at a higher position than that in the no-staple mode. As shown in FIG. 29, the tray 24 supports the leading end of the sheet S to help its return to the upstream side in the ejecting direction.

As shown in FIG. 29, the sheet S ejected to the staple tray 38 is allowed to slide toward the upstream side in the ejecting direction by its own weight because the inclination of the staple tray 38 and the sheet dropping position are set higher (tray shift control 2). In addition, the sheet is biased toward the upstream side on the staple tray 38 by the ejecting aligning belt 19 that rotates in synchronism with the ejecting roller 17.

The sheet S abuts against the abutment plate 20 and aligns itself in a direction parallel with the ejecting direction. The sheet is aligned in its widthwise direction in the following manner. The width aligning guide 21 in FIGS. 3 and 4 starts the operation within a predetermined period of time during which the sheet S slidably drops on the stable tray 38 and abuts against the abutment plate 20. The width aligning guide 21 moves from the rear side to the front side a predetermined distance in the widthwise direction of the sheet S, thereby aligning the sheet S on the front side. For the second and subsequent sheets, the above operation is repeated until all the sheets set by the user are loaded on the staple tray 38. That is, sheet ejecting control 2 (to be described later) is performed.

Figure 30:
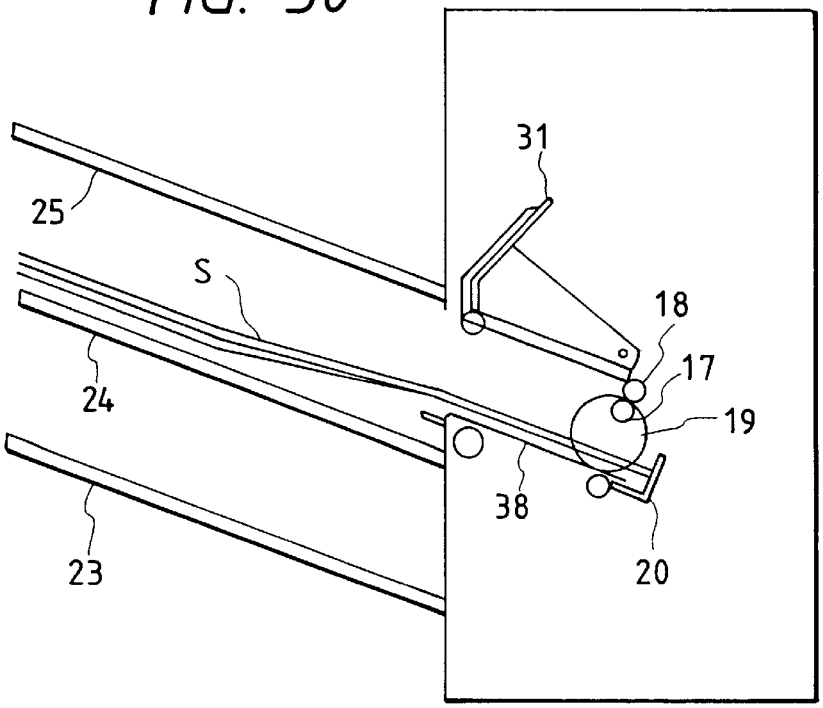
FIG. 30 is a side view showing a state in which sheets the number of which is set by a user are aligned on a staple tray.
Figure 31:
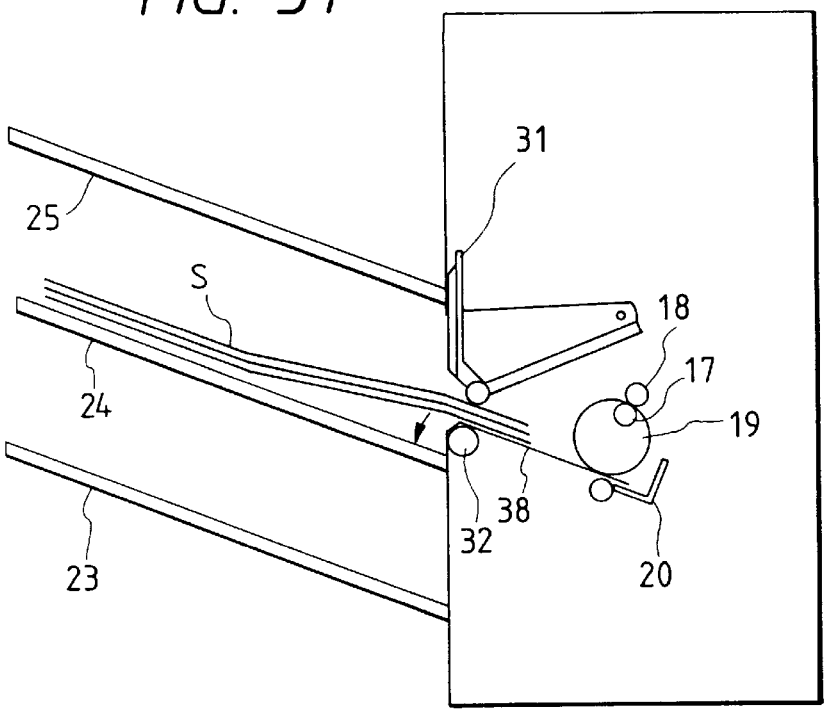
FIG. 31 is a side view showing a state in which stapled sheets are being ejected.
Figure 32:
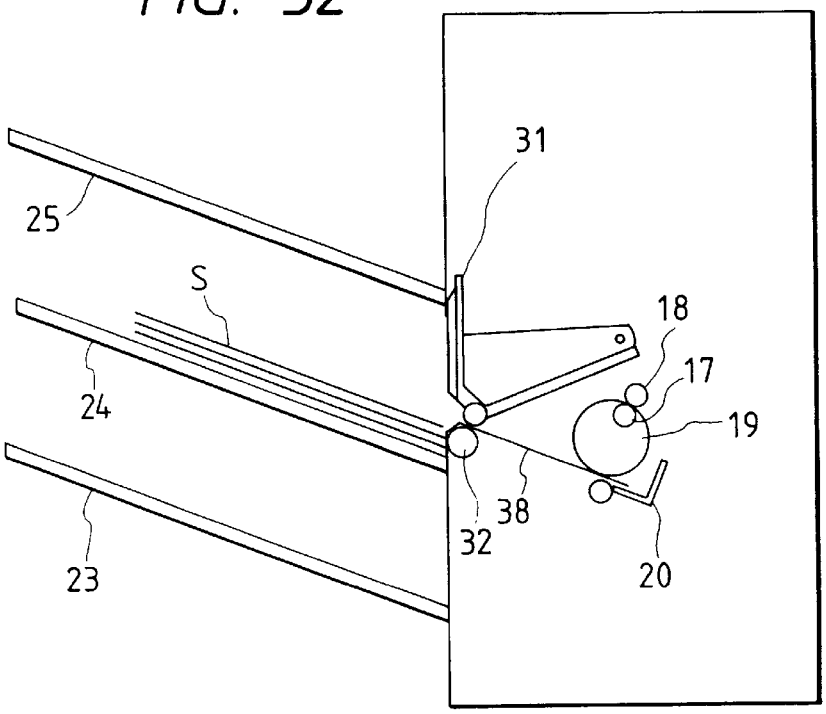
FIG. 32 is a side view showing a state in which the stapled sheets have been ejected.

When the number of sheets designated by the user are aligned on the staple tray 38, as shown in FIG. 30, the staple operation is started. As previously described, the sheets are stapled at a position or positions set by the user. At the end of stapling, the swinging guide 31 is lowered, as shown in FIG. 31. The ejecting roller 32 rotates in the direction of the arrow, so that the bundle Sa of stapled sheets on the tray 38 are ejected onto the tray 24, as shown in FIG. 32. A so-called sheet ejecting control 3 is performed.

In the staple operation, since sheets are sequentially ejected from the copying apparatus 100, the first sheet of the ejected sheets of the next job is left in the copying apparatus 1, and the second sheet is ejected together with the first sheet overlapping it.

Figure 33:
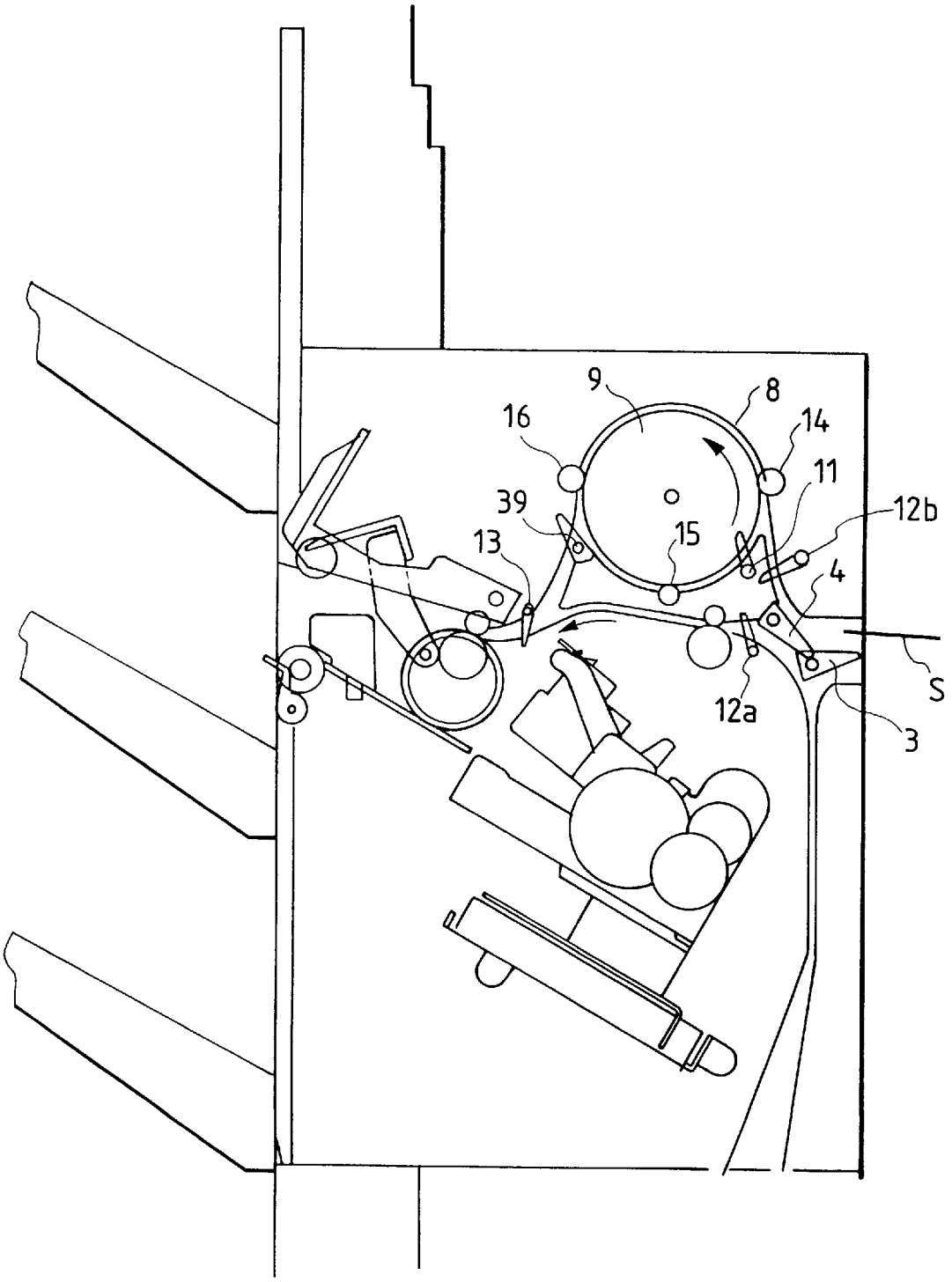
FIG. 33 is a side view showing a state in which a sheet starts entering the sheet post-processing apparatus.

This operation will be described with reference to FIGS. 33 to 36. FIG. 33 shows a state in which a sheet S starts entering the apparatus.

Figure 34:
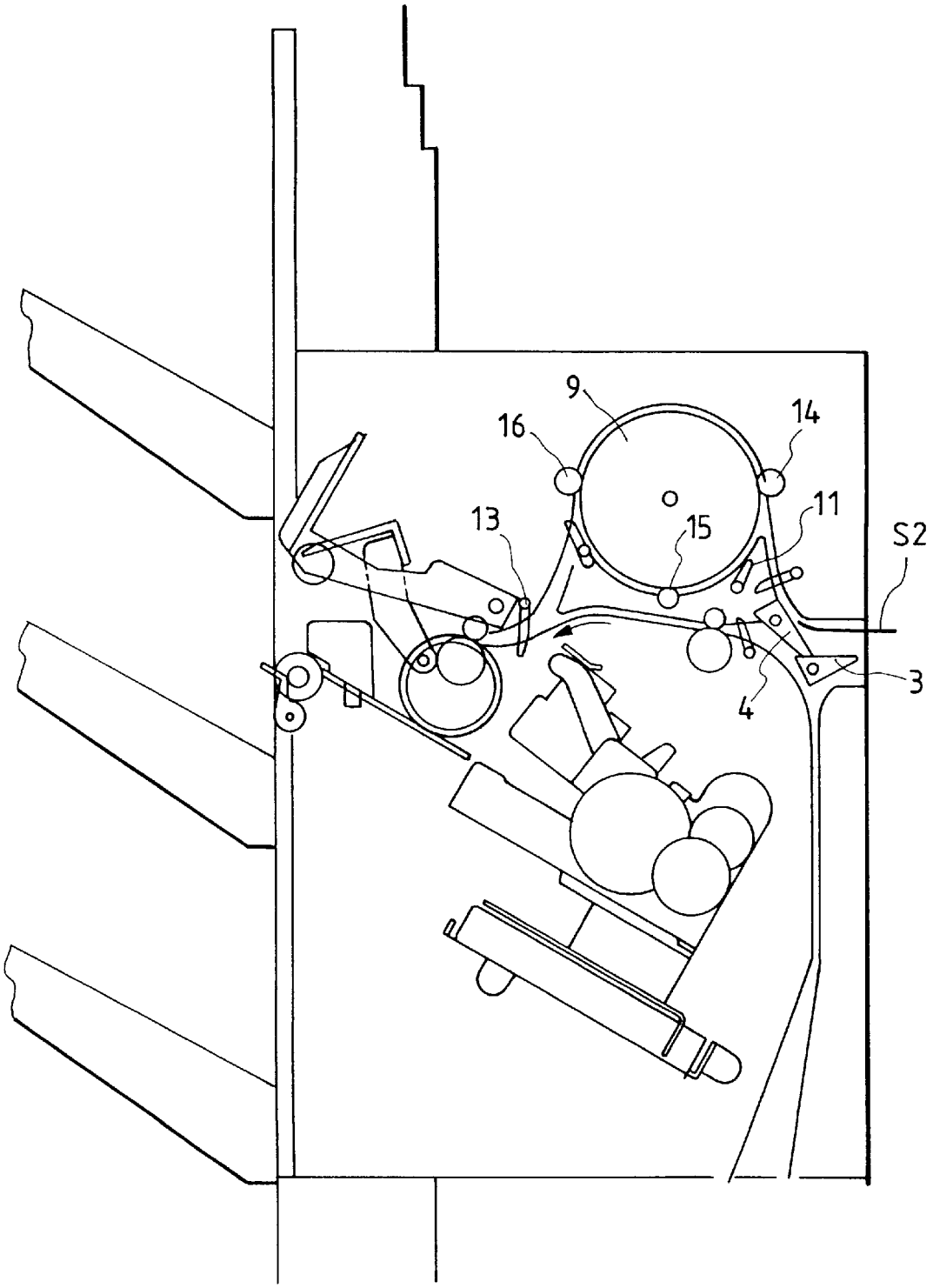
FIG. 34 is a side view showing a state in which the first sheet is wound on a buffer roller.
Figure 35:
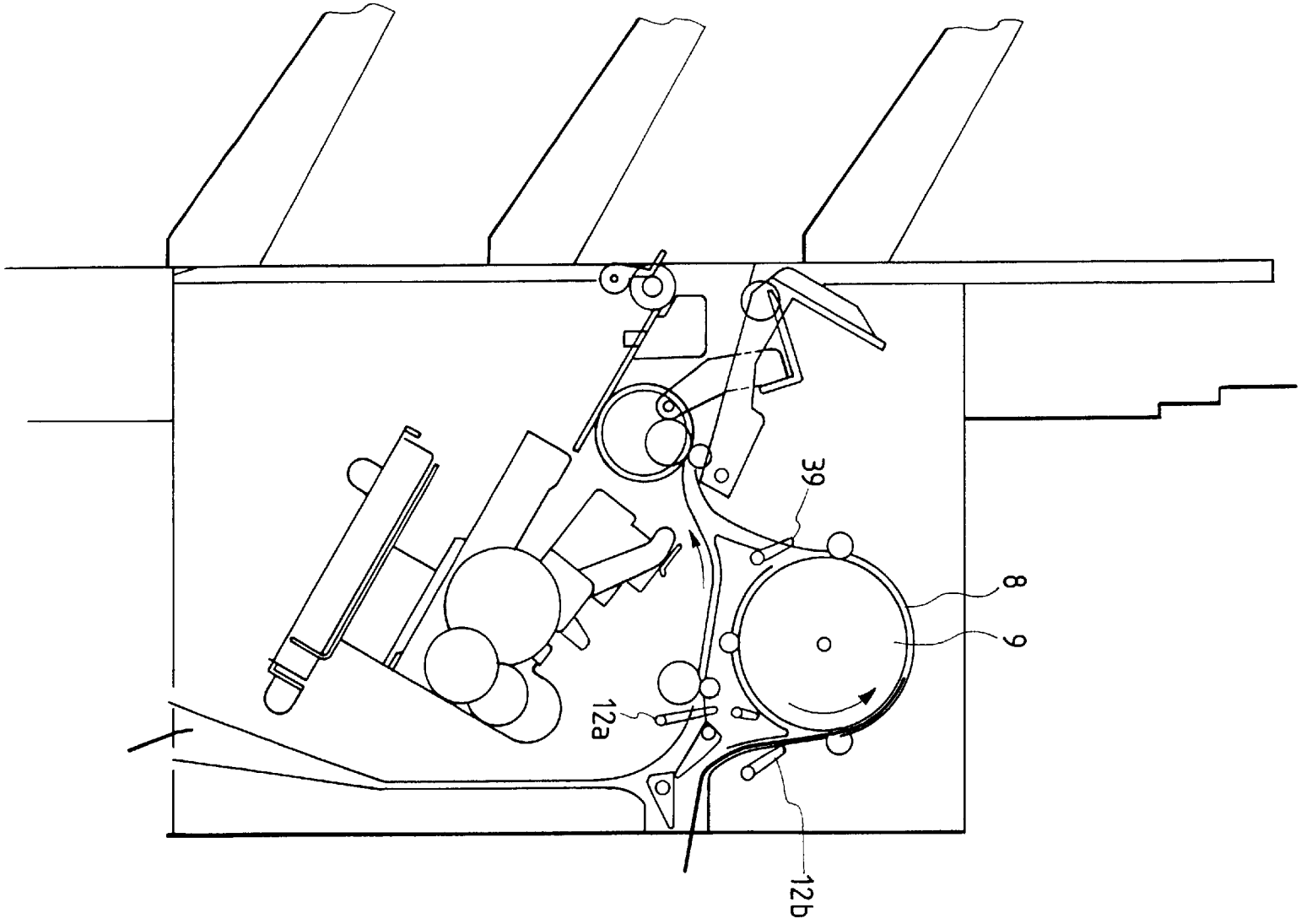
FIG. 35 is a side view showing a state in which the first and second sheet S1 and S2 are conveyed in an overlapping manner.
Figure 36:
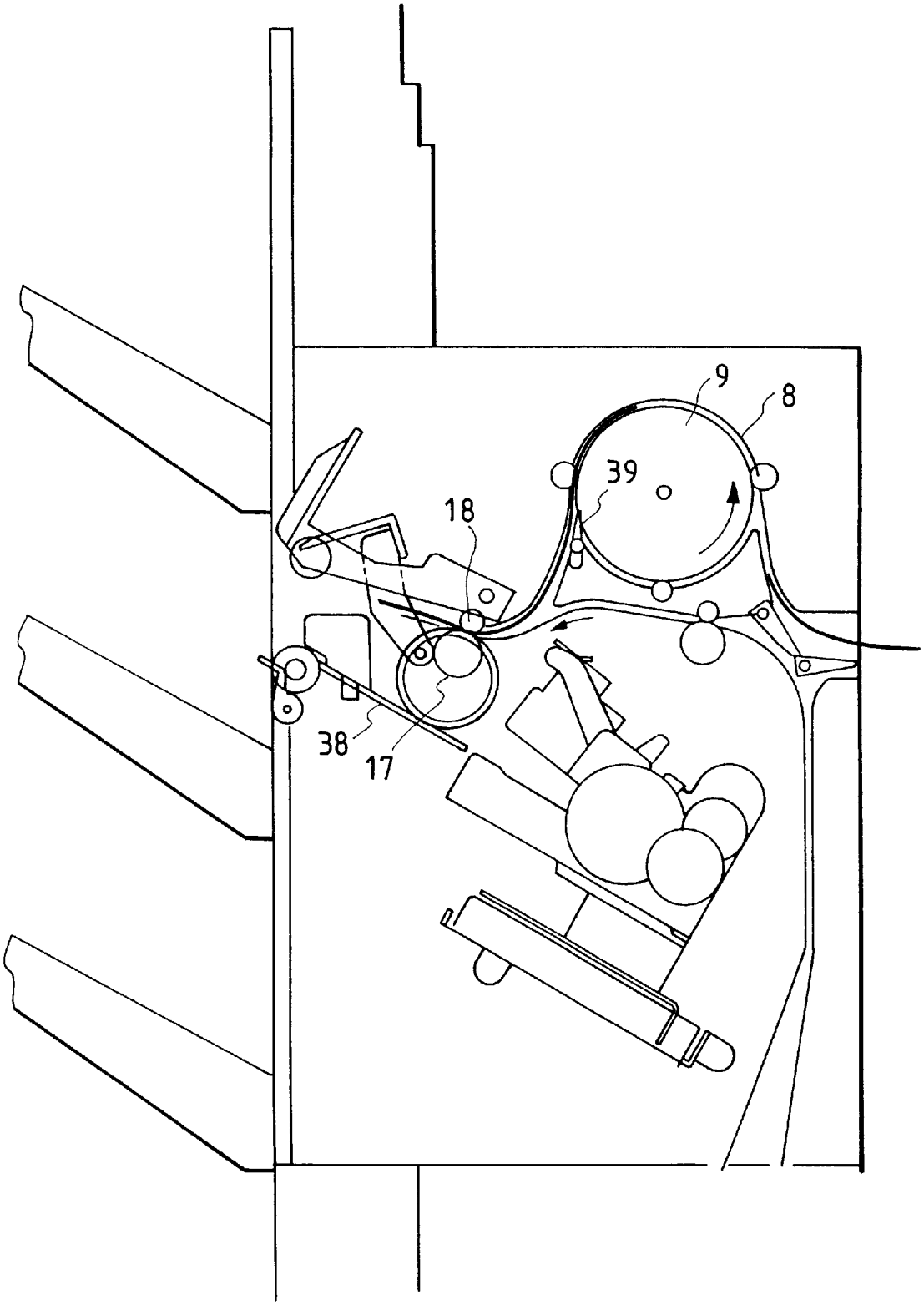
FIG. 36 is a side view showing a state in which two sheets in the overlapping manner are ejected.

A first sheet S1 ejected from the copying apparatus 100 is fed to the buffer path 8 because the upstream end portions of the flappers 3 and 4 are located at the lower positions. The sheet S1 fed to the buffer path 8 is fed in the direction of the arrow while it is wound on the buffer roller 9. In this case, a flapper 39 pivots to feed the sheet in the direction of the roller 15. The sensor 11 detects the leading end of the sheet S1, and the sheet is stopped in a state shown in FIG. 34. As shown in FIG. 34, when a second sheet S2 enters, the buffer roller 9 starts to rotate, and the first and second sheets S1 and S2 are conveyed overlapping each other, as shown in FIG. 35. When the trailing end of the first sheet S1 has passed through the flapper 39, the flapper 39 pivots to feed the sheet S to the ejecting rollers 17 and 18, as shown in FIG. 36. The overlapping sheets are ejected to the staple tray 38. By the above operations, during the staple operation of the stopper, no sheet is ejected from the ejecting rollers 17 and 18, thereby allowing execution of the staple operation and preventing the stop of the copying apparatus 100.

To assure the necessary staple stroke time, the third and subsequent sheets may be wound on the buffer roller 9.

By repeating the above operations, a plurality of copies each consisting of a bundle Sa of stapled sheets are formed. As shown in FIG. 9, if a plurality of copies each consisting of a bundle Sa of stapled sheets are already present on the tray 24, when the upper end of the uppermost bundle Sa of stapled sheets exceeds point G, it may catch the next sheet to cause a jam, or degrade the aligning precision of the width aligning guide 21, provided that the flexure or total thickness of the plurality of copies is large.

In this case, however, as previously described, the roller guide 34 is located on the same level as that of the lower hurdle guide 27*a*, and the stopper 30 projects above the tray 24 so as to press the upper end face of copies each consisting of a bundle Sa of stapled sheets on the tray 24. Therefore, the upper end of the uppermost copy will not exceed point G.

The control operation of the CPU 600 of the sheet post-processing apparatus 1 used in sheet loading together with the digital copying machine having the above arrangement will be described with reference to flowcharts in FIGS. 37 to 45.

Figures 37, 37A:
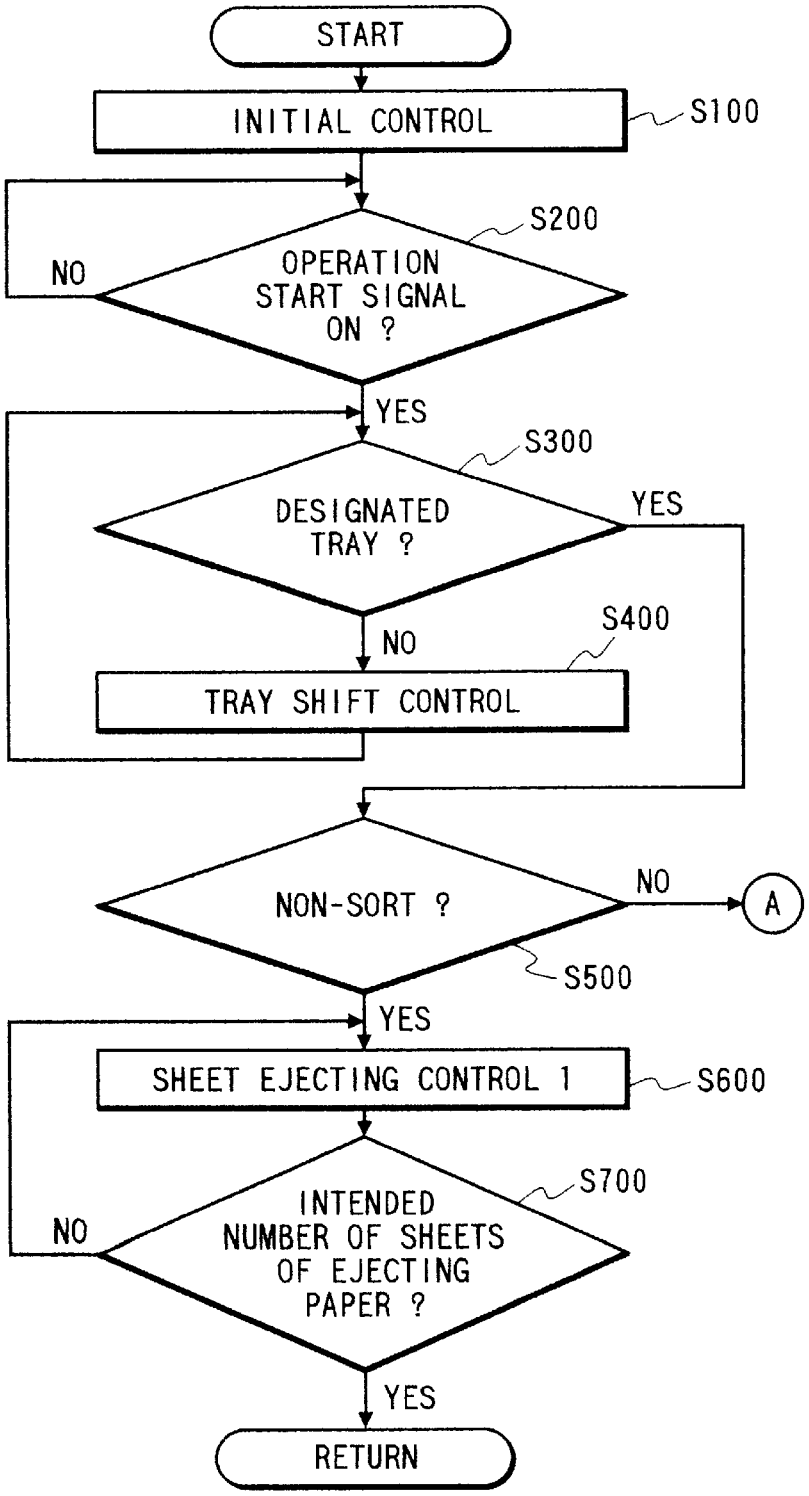
FIG. 37 which is comprised of FIGS. 37A and 37B is a flow chart showing an example of the control sequence in the sheet post-processing apparatus of the present invention.
Figure 37B:
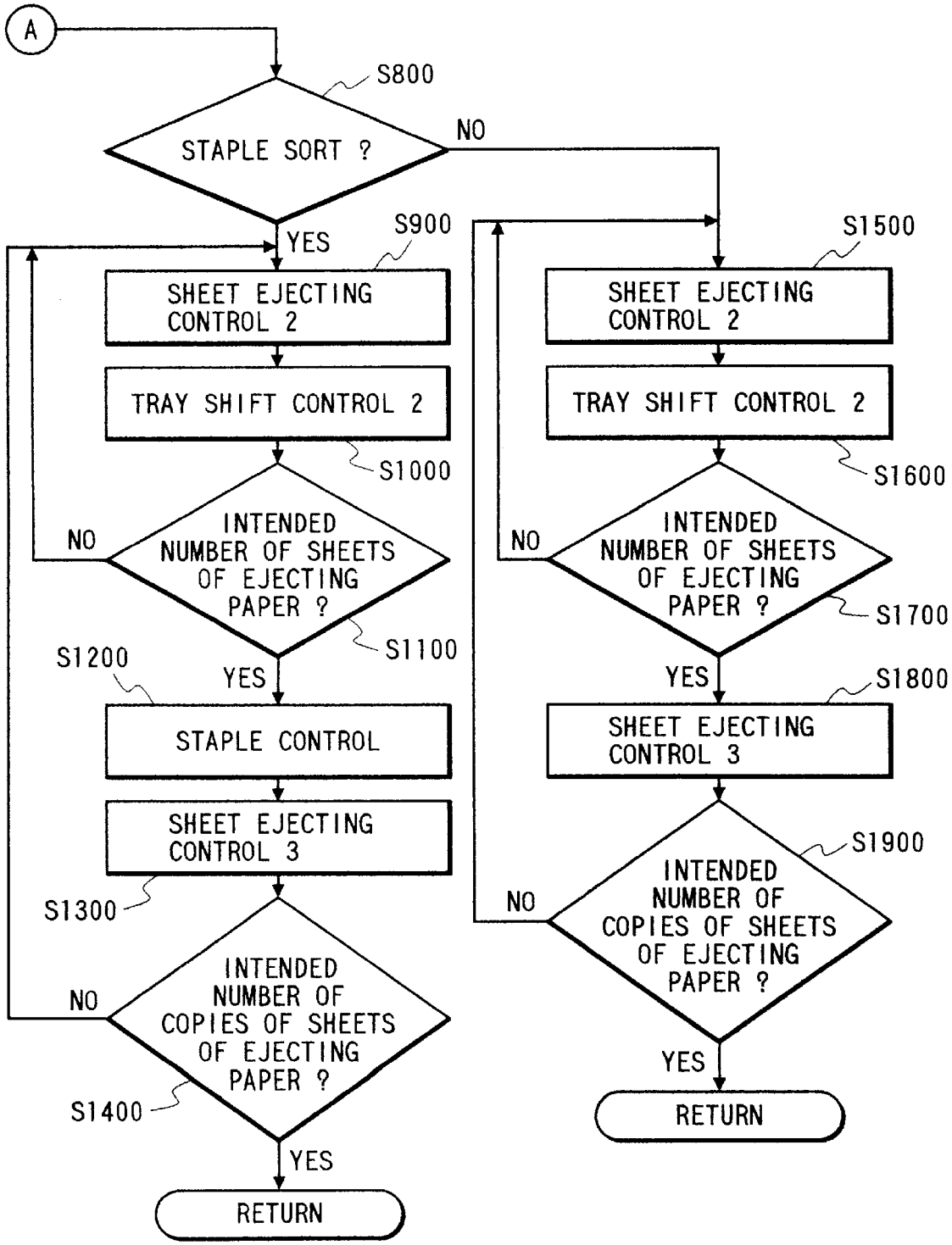
Figure 38:
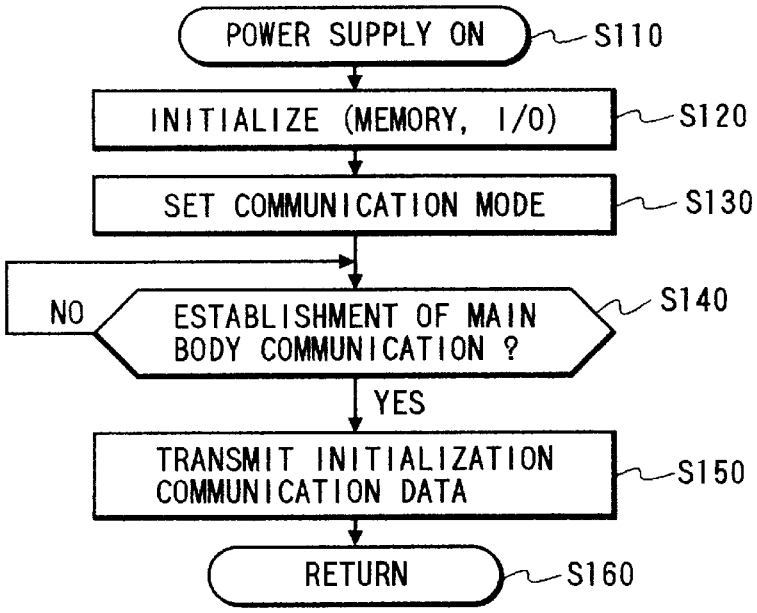
FIG. 38 is a flowchart showing an example of an initial control sequence in the above control sequence.

In FIGS. 37A and 37B showing the flowchart of the overall control sequence of the sheet post-processing apparatus 1, initial control for initialization is performed in step S100. The details of this control will be described with reference to the flow chart of FIG. 38. When the power supply of the sheet post-processing apparatus 1 is turned on in step S110, the flow advances to step S120 to initialize the I/O ports and the memory (RAM). The flow then advances to step S130 to set a communication mode with a facsimile apparatus, a printer, or a copying machine. It is determined in step S140 whether communication with the copying apparatus (main body) is established. If YES in step S140, the flow advances to step S150 to transmit initialization communication data (e.g., a standby signal of the sheet post-processing apparatus 1) from the sheet post-processing apparatus 1.

On the other hand, after the initialization communication data is transmitted as described above, the sheet post-processing apparatus 1 waits for an operation start signal.

When the operation start signal is received in step S200, the sheet post-processing apparatus 1 advances to step S300 to determine whether a designated tray is in position at the sheet ejecting port. If NO in step S300, the flow advances to step S400 to perform tray shift control so as to set the designated tray at a predetermined position.

In this tray shift control, it is determined whether the tray position is confirmed. If not, the tray is operated to the home position. Upon completion of the shift of the tray to the home position, the tray is operated by a predetermined amount.

If it is determined in step S300 that the designated tray is positioned at the sheet ejecting port, the flow advances to step S500 to determine whether the non-sort mode is set. If YES in step S500, the flow advances to step S600 to perform sheet ejecting control (to be described later).

If, however, it is determined in step S500 that the non-sort mode is not set, the flow advances to step S800 to determine whether the staple mode is set. If YES in step S800, the flow advances to step S900 to perform sheet ejecting control 2 in which sheets are ejected to the staple tray 38. Along with this operation, in step S1000, the above-mentioned tray shift control 2 is performed. When it is determined in step S1100 that an intended number of sheets of ejecting paper are ejected, the flow advances to step S1200 to perform the above-mentioned staple control. The flow then advances to step S1300 to perform sheet ejecting control 3 as control for ejecting a bundle of sheets. The flow further advances to step S1400. The operations from step S900 are repeated until the number of copies becomes an intended number of copies of sheets of ejecting paper.

When it is determined in step S800 that the staple mode is not set, the flow advances to step S1500. Steps S1600 and S1700 are performed as in steps S900, S1000 and S1100. The flow then advances to step S1800 to eject the bundle of sheets as in step S1300. Note that these sheets are not stapled, as a matter of course. The flow advances to step S1900, and the operations from step S1600 are repeated until the number of copies becomes the intended number of copies of sheets of ejecting paper.

The details of the above-mentioned sheet ejecting control 1 will be described with reference to the flowcharts from FIG. 39.

In the non-sort mode of sheet ejecting control 1, as can be apparent from the above description, sheets are ejected from the ejecting port 50 to the tray one by one in step S2000.

When sheet ejection is complete, the flow advances to step S3000 to perform a sheet surface detecting routine. More specifically, in the flowchart shown in FIG. 40, it is determined in step S3100 whether a sheet or sheets have been ejected to a tray. This determination is performed on the basis of the measurement data from the distance sensor 60 as described above. When it is determined that a sheet or sheets have been ejected, the flow advances to step S3200 to increment n representing the number of ejected sheets. Note that the corresponding distance measuring data (distance between the ejecting port 50 and the upper surface of the sheet) is Hn.

Referring back to FIG. 39, after the sheet surface detecting routine in step S3000 is complete, the flow advances to step S3500 to determine whether $H-n\cdot\alpha \leqq Hn$ (where H is the distance (corresponding to L3' (see FIG. 33) between the tray loading surface (no sheet) and the ejecting port in the initial position of the tray), and $\alpha$ is the thickness (loading height) of one sheet). Note that "$H-n\cdot\alpha$" represents the distance between the upper surface of the sheet and the ejecting port 50 intended in sheet loading on the tray. When this data is equal to or smaller than actual distance measuring data Hn (see FIG. 33), it indicates that the sheets are normally loaded.

In this case, the flow advances to step S5000 to execute a no-curl processing routine. In step S5000 of the no-curl processing routine, a loading amount determining processing routine is executed in step S5100, as shown in FIG. 41.

Figure 42:
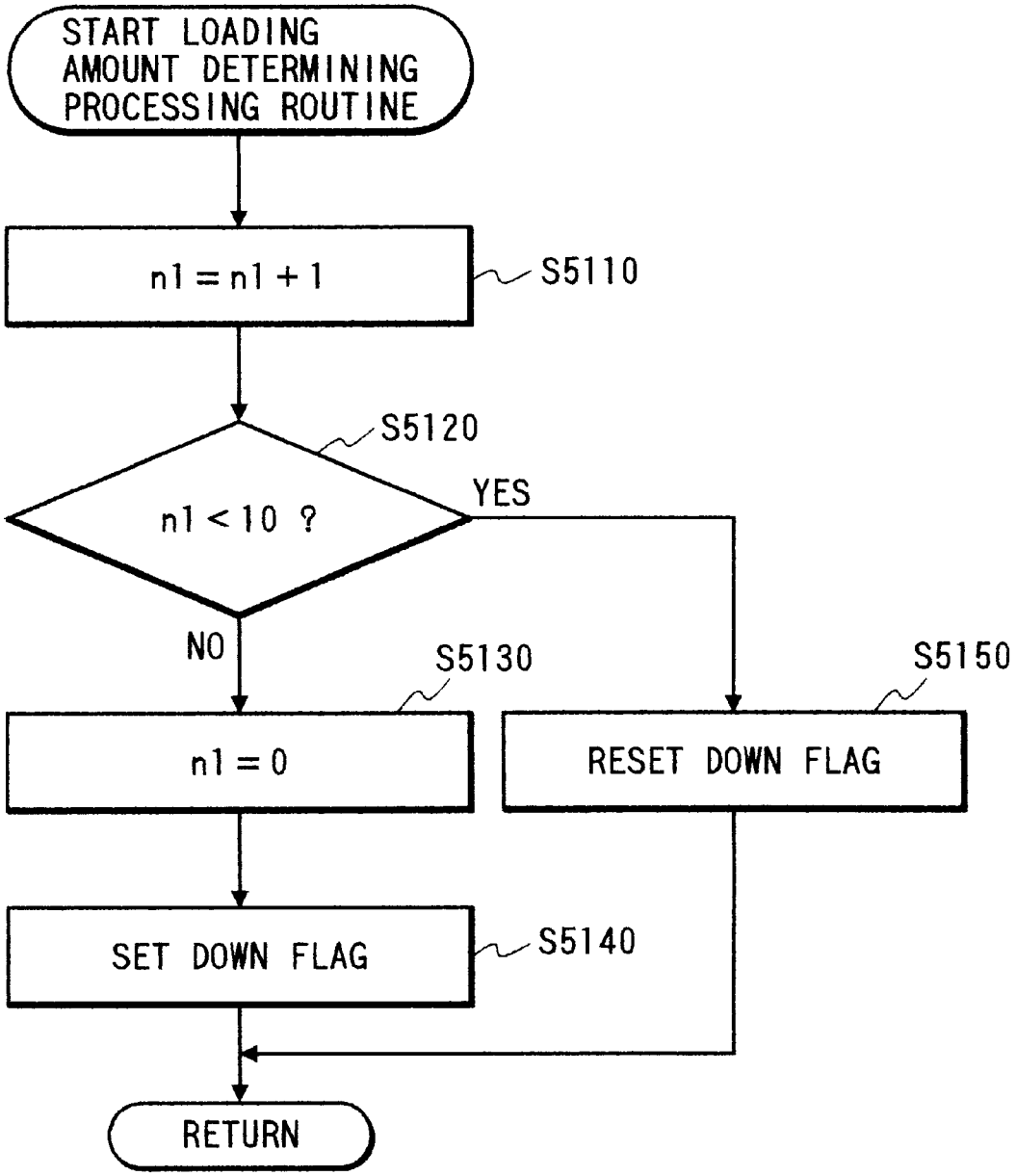
FIG. 42 is a flowchart showing an example of a loading amount determining processing routine in the above control sequence.
Figure 43:
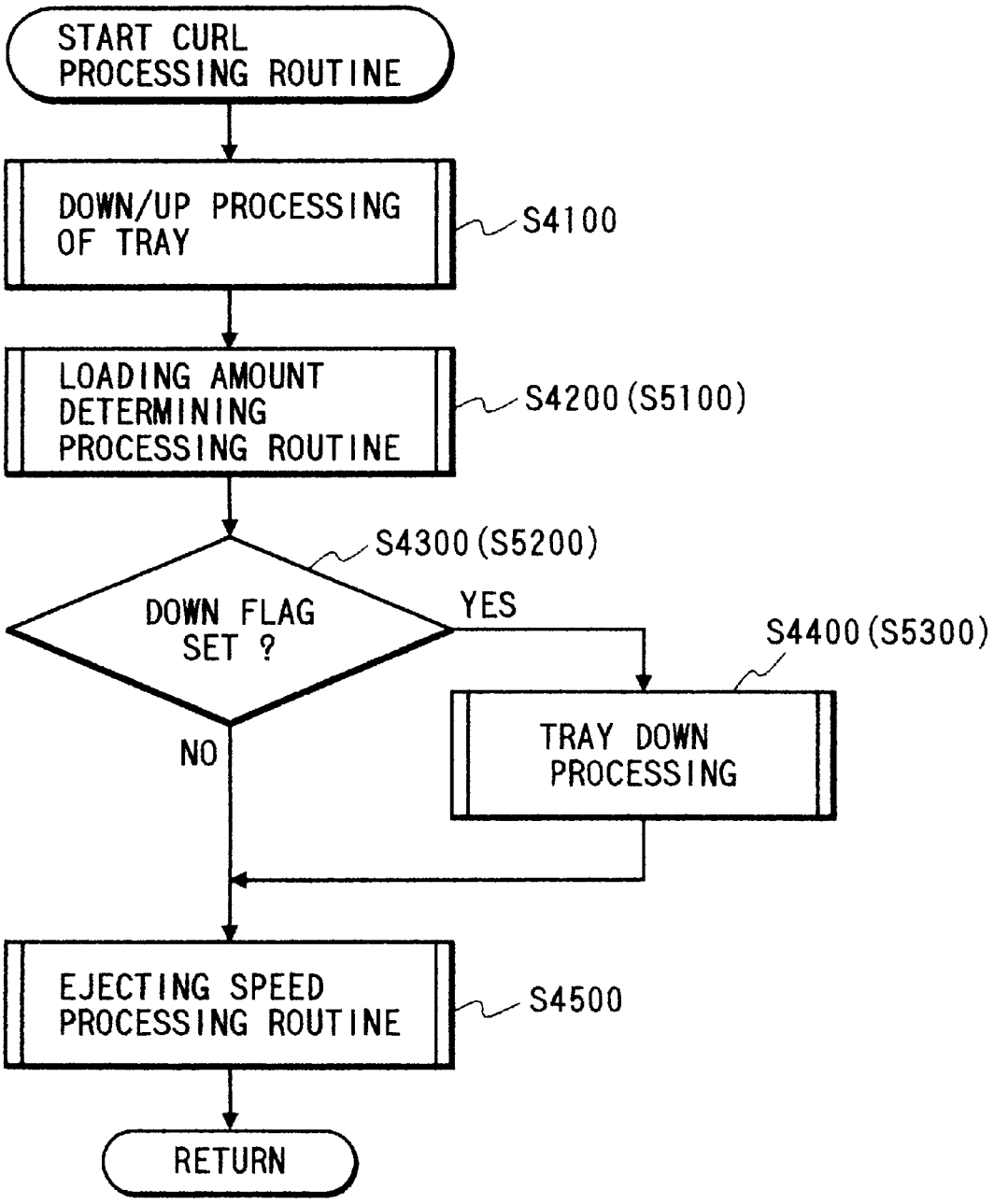
FIG. 43 is a flowchart showing an example of a curl processing routine in the above control sequence.

The loading amount determining processing routine is shown in FIG. 42. This routine is to determine whether a predetermined number of sheets have been ejected. In step S5110, a count value n1 (this value is cleared every 10 sheets in this embodiment) representing the number of sheets of ejecting paper is incremented by one. In step S5120, it is determined whether $n1<10$. If YES in step S5120, the flow advances to step S5150 to reset a down flag (to be described later). On the other hand, if NO in step S5120, the flow advances to step S5130 to clear n1 to 0. The down flag is then set in step S5140.

Figure 41:
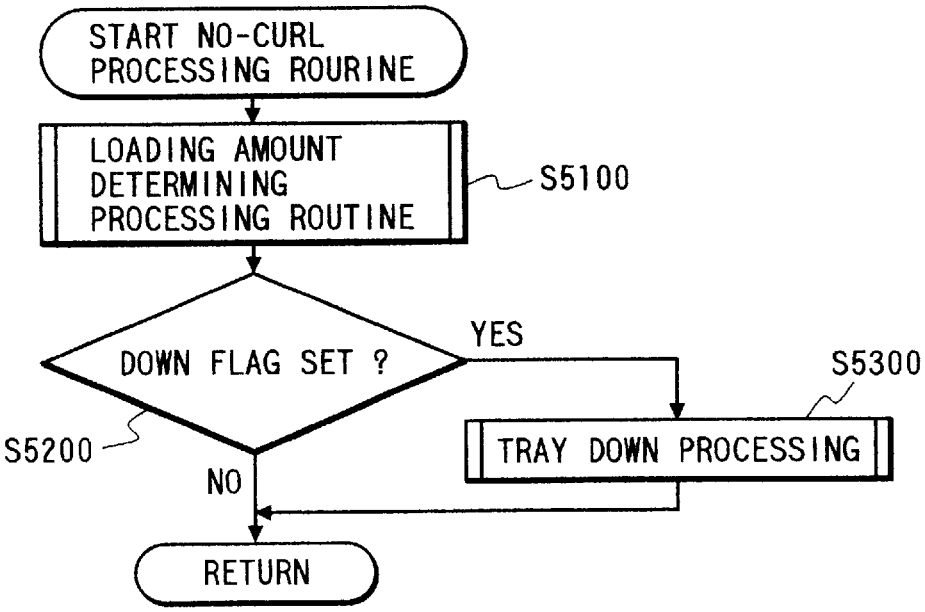
FIG. 41 is a flowchart showing an example of a no-curl processing routine in the above control sequence.

The flow returns to the no-curl processing routine in FIG. 41. After the loading amount determining processing routine in step S5100, it is determined in step S5200 whether the down flag is set. If YES in step S5200, this indicates that, for example, 10 sheets have been loaded on a tray, and the flow advances to step S5300 to perform tray down processing. This tray down processing is to shift the tray downward the distance corresponding to the loading height of 10 sheets. This assures a sufficient distance between the ejecting port 50 and the upper surface of the uppermost sheet, thereby preventing jamming or the like. When the down flag is not set in step S5200, the no-curl processing routine is directly ended.

Figure 39:
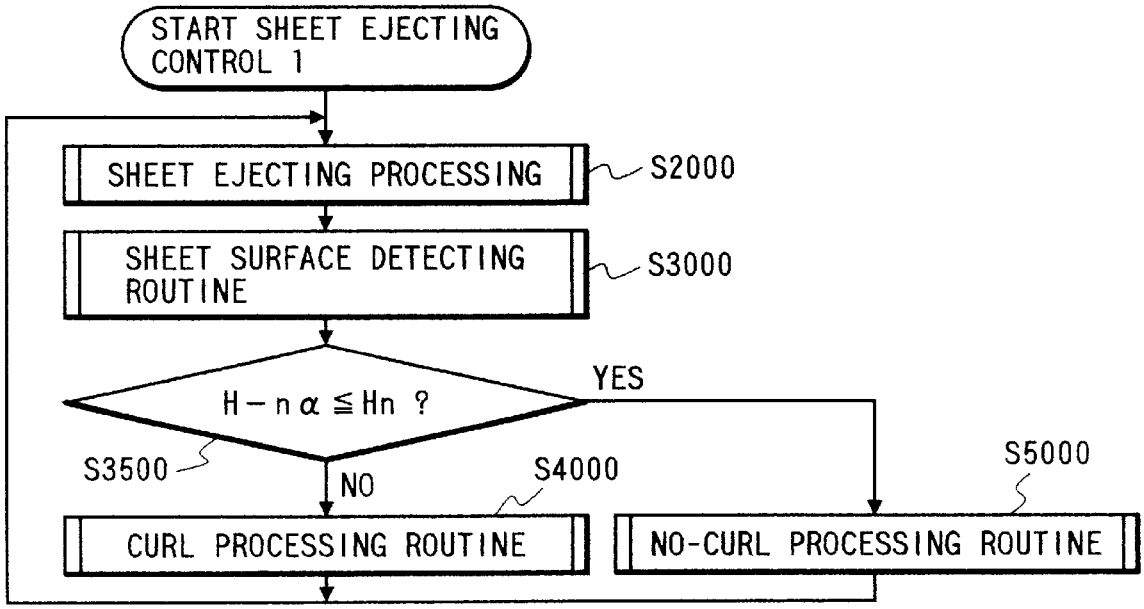
FIG. 39 is a flowchart showing an example of a sheet ejecting control sequence in the above control sequence.
Figure 40:
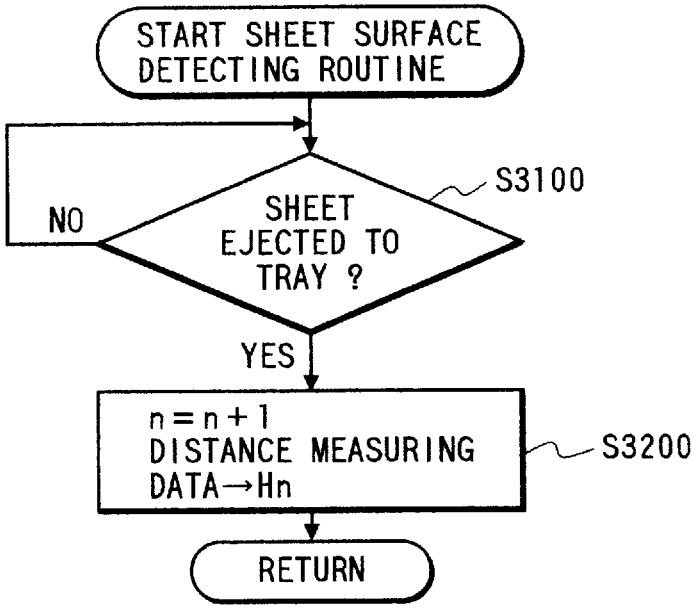
FIG. 40 is a flowchart showing an example of a sheet surface detecting routine in the above control sequence.

When it is determined in step S3500 in FIG. 39 that the distance between the upper surface of the uppermost sheet and the ejecting port 50 intended by sheet loading on the tray is smaller than the actual distance measuring data Hn, the trailing end of the loaded sheet may have been caught by the ejecting port 50 or the like, and the sheet may be bent (curled), as shown in FIG. 10. The flow advances to step S4000 for curl processing routine.

Figure 44:
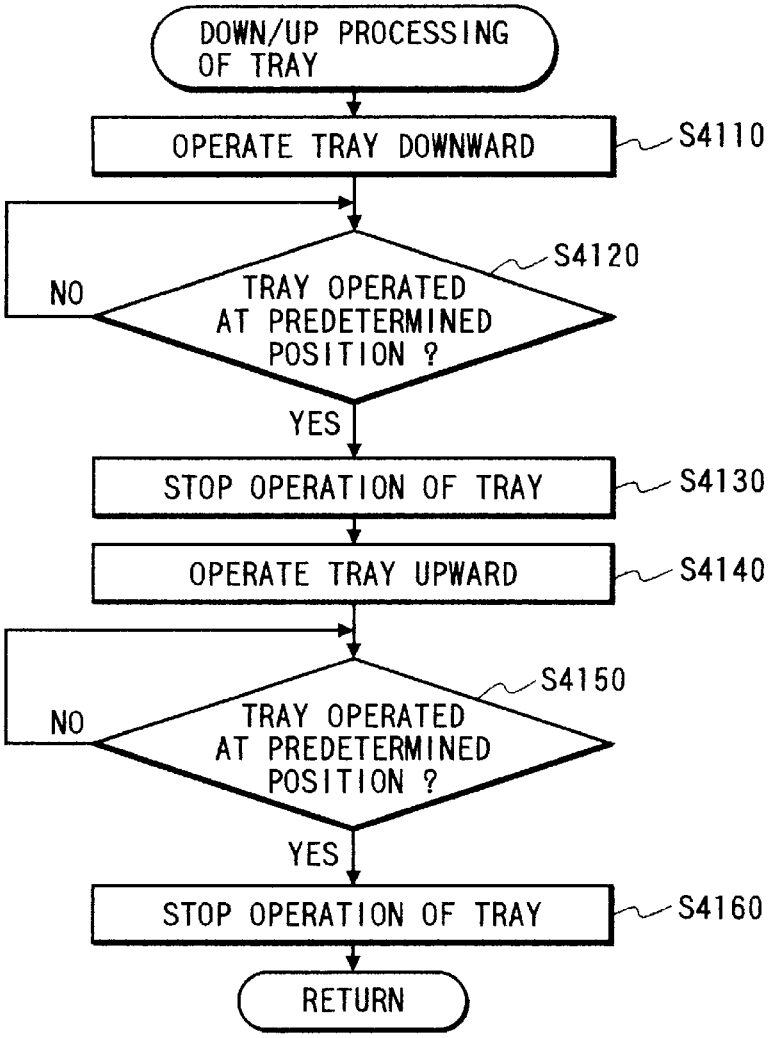
FIG. 44 is a flowchart showing an example of a down/up processing routine of a tray in the above control sequence.

In the curl processing routine, down/up processing of the tray is performed in step S4100. This down/up processing is processing for temporarily operating the tray in the state shown in FIG. 10 downward and then operating it upward to the original position. More specifically, as shown in FIG. 44, the tray is operated downward in step S4110, is operated to a predetermined position in step S4120 and is stopped at this position in step S4130. In step S4140, the tray is operated upward and further operated upward to the predetermined position in step S4150. The tray is then stopped at this predetermined position in step S4160.

By this operation, the trailing end of the sheet caught by the ejecting port 50 can be released, and the sheet can be loaded in a normal state. Upon completion of the down/up processing, the flow advances to step S4200 to execute the loading amount determining processing routine (step S5100) in FIG. 42 described as in the no-curl processing routine described. Whether the down flag is set in step S4300 and the tray down processing in step S4400 are identical to those in steps S5200 and S5300 described in the no-curl processing routine, and a repetitive description will be omitted.

Figure 45:
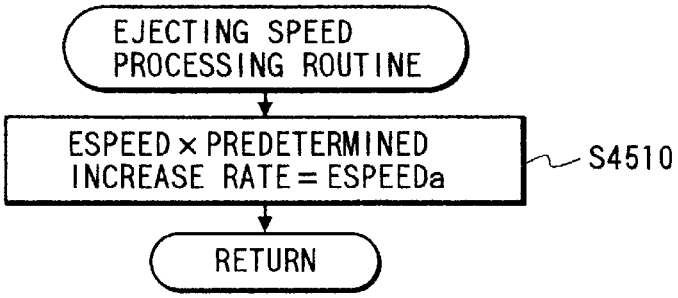
FIG. 45 is a flowchart showing an example of an ejecting speed processing routine in the above control sequence.
Figure 46:
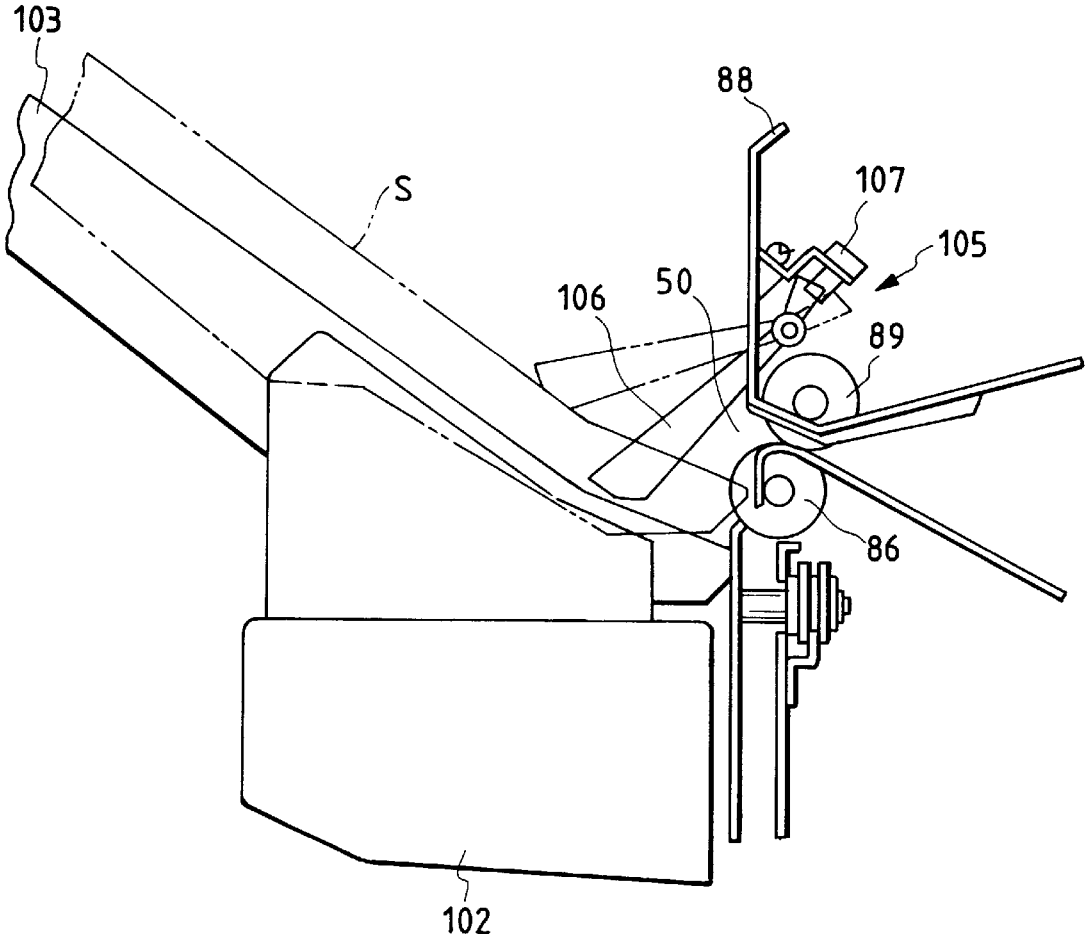
FIG. 46 is a side view showing the main part of a conventional sheet post-processing apparatus.
Figure 47:
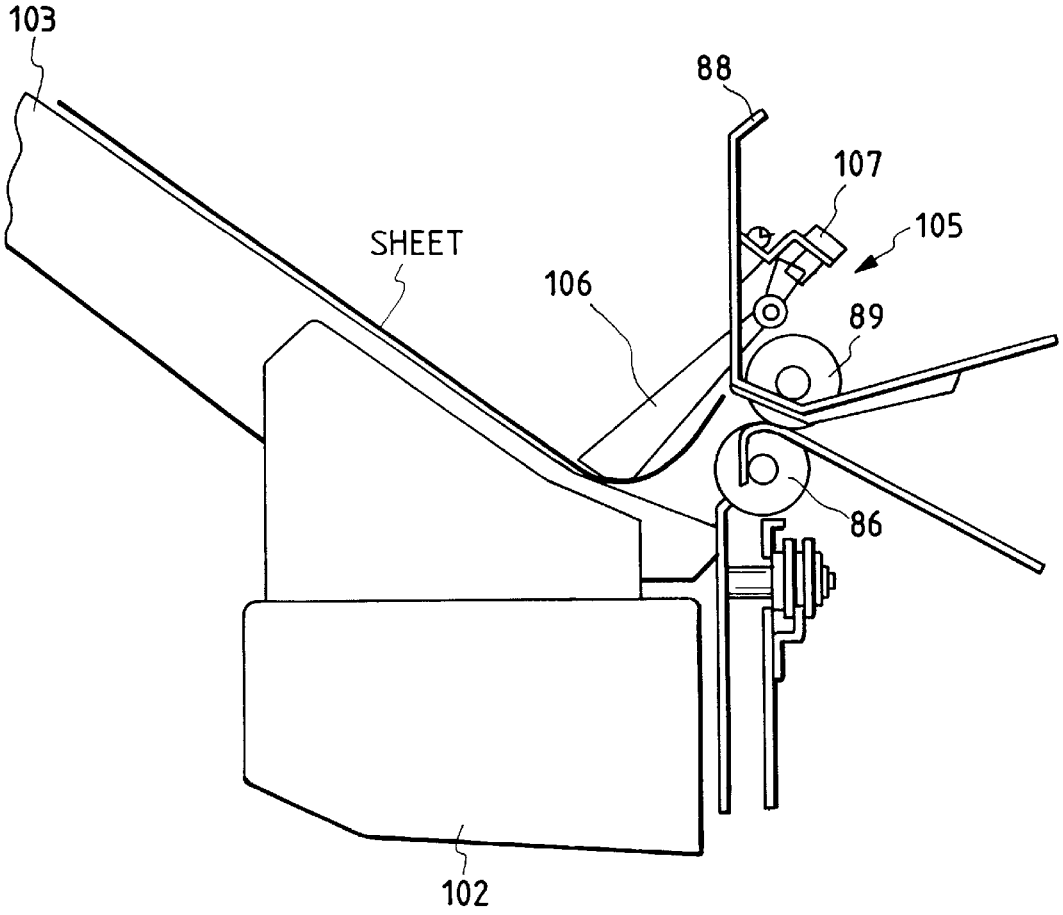
FIG. 47 is a view showing a state in which the trailing end of a sheet is kept bent in a conventional sheet post-processing apparatus.

After steps S4300 and S4400, the flow advances to step S4500 to execute an ejecting speed processing routine. More specifically, as shown in FIG. 45, in this ejecting speed processing routine, a sheet ejecting speed ESPEED of the ejecting rollers 32 and 33 is multiplied by a predetermined increase rate to obtain ESPEEDa in step S4510. As can be apparent from the flowchart in FIG. 39, the next and subsequent sheet ejecting processing operations are performed at an ejecting speed increased in the curl processing routine.

With the above arrangement, sheets are ejected on a tray at the increased ejecting speed, and the probability that a sheet is caught by the ejecting port 50 can be reduced. Therefore, the sheets can be quickly loaded and stored.

In sheet ejecting control 3 in a mode other than the non-sort mode, the above-mentioned sheet ejecting control 1 for each sheet is performed for each bundle of sheets. That is, in the above description, a "bundle of sheets" replaces a "sheet", and n reads the number of copies each consisting of a bundle of sheets, and $\alpha$ reads the thickness of a bundle of sheets. A repetitive description will therefore be omitted.

In the above description, a distance (distance measuring) sensor is arranged above an ejecting tray. However, a distance measuring sensor may be arranged above a paper feed tray on which sheets to be fed to an image forming apparatus are loaded, and lifting control of the paper feed tray, sheet remaining amount detection, and sheet presence/absence detection may be performed on the basis of the sensor output.

Note that the present invention is applicable to an electromagnetic sensor in addition to an optical sensor.

What is claimed is:

1. A sheet loading apparatus for loading a sheet ejected from an image forming apparatus, comprising:

conveying means for receiving the sheet ejected from said image forming apparatus and conveying the sheet;

loading means for loading the sheet conveyed by said conveying means;

shifting means for vertically shifting said loading means;

non-contact distance measuring means, arranged above said loading means, for measuring a distance to an upper surface of the sheet loaded on said loading means;

determining means for determining a loaded state of the sheet on said loading means in accordance with a distance measuring result of said distance measuring means; and control means for causing said shifting means to control and shift said loading means to eliminate an abnormality when it is determined in accordance with a determination result of said determining means that the abnormality has occurred in the loaded state.

2. An apparatus according to claim 1, wherein said distance measuring means comprises a distance measuring sensor having an irradiation unit for irradiating light toward said loading means and a light-receiving unit for receiving reflected light of the light irradiated from said irradiation means.

3. An apparatus according to claim 2, wherein said light-receiving unit of said distance measuring sensor comprises a PSD light-receiving element, and said irradiation unit of said distance measuring sensor is controlled to irradiate light every time said conveying means loads a sheet to said loading means.

4. An apparatus according to claim 1, wherein said determining means determines an abnormal loaded state when the distance measuring result of said distance measuring means represents a value greatly reduced from an intended distance decrease obtained by adding a distance decrease caused by a newly loaded sheet.

5. An apparatus according to claim 1, wherein said control means causes said shifting means to control and shift said loading means such that said loading means is temporarily shifted downwardly and then shifted upwardly when an abnormal loaded state is determined.

6. An apparatus according to claim 1, wherein said control means controls to increase a conveying speed of said conveying means in a subsequent operation to be higher than the predetermined speed when said determining means determines an abnormal loaded state.

7. An apparatus according to claim 1, wherein said control means controls said shifting means to shift said loading means a predetermined amount every time a predetermined number of sheets are loaded on said loading means.

8. A sheet loading apparatus comprising:

loading means for loading a sheet;

ejecting means for ejecting the sheet onto said loading means;

non-contact distance measuring means, disposed above said loading means, for measuring a distance between a predetermined position and an upper surface of the sheet loaded on said loading means;

determining means for determining an abnormal loaded state on said loading means in accordance with a change in distance measuring result of said distance measuring means; and shifting means for shifting said loading means a predetermined amount when said determining means determines the abnormal loaded state.

9. An apparatus according to claim 8, wherein said distance measuring means comprises emitting means for emitting a distance measuring wave toward the upper surface of the sheet and receiving means for receiving the distance measuring wave reflected by the upper surface of the sheet.

10. An apparatus according to claim 9, wherein said emitting means comprises one emitting means, and said receiving means comprises one receiving means.

11. An apparatus according to claim 9, wherein said distance measuring means measures distance in accordance with an intensity of a wave received by said receiving means.

12. An apparatus according to claim 9, wherein said loading means has an opening portion on a path of a wave from said emitting means.

13. An apparatus according to claim 12, further comprising determining means for determining the presence/absence of a sheet on said loading means in accordance with the distance measuring result of said distance measuring means.

14. An apparatus according to claim 13, wherein said loading means comprises a plurality of loading means stacked in a vertical direction, and said determining means determines the presence/absence of a sheet in accordance with whether the distance measuring result of said distance measuring means is a distance close to a distance between loading means of interest and the predetermined position or a distance between the predetermined position and loading means located below said loading means of interest.

15. An apparatus according to claim 8, wherein said ejecting means ejects onto said loading means a sheet received from an image forming apparatus.

16. An apparatus according to claim 8, further comprising shifting means for vertically shifting said loading means, and wherein said shifting means shifts said loading means in accordance with a distance measuring result of said distance measuring means.

17. An apparatus according to claim 8, further comprising determining means for determining a loading amount of sheets on said loading means in accordance with the distance measuring result of said distance measuring means.

18. An apparatus according to claim 8, wherein said shifting means shifts said loading means downwardly and then upwardly to recover from the abnormal loaded state.

19. A sheet loading apparatus comprising:

loading means for loading a sheet;

ejecting means for ejecting the sheet onto said loading means;

distance measuring means for measuring a distance between a predetermined position and an upper surface of the sheet loaded on said loading means;

judgement means for judging whether the distance measured by said distance measuring means exceeds a prediction distance accordingly to the number of sheets ejected onto said loading means; and shifting means for shifting said loading means downwardly and then upwardly accordingly as said judgement means judges that the measured distance exceeds the prediction distance.

20. A sheet loading apparatus for loading a sheet ejected from an image forming apparatus, comprising:

conveying means for receiving the sheet ejected from the image forming apparatus and conveying the sheet;

loading means for loading the sheet conveyed by said conveying means;

shifting means for vertically shifting said loading means;

non-contact distance measuring means, arranged above said loading means, for measuring a distance to an upper surface of the sheet loaded on said loading means;

control means for controlling said shifting means so as to shift said loading means in accordance with a distance measuring result of said distance measuring means; and determining means for determining a loaded state of the sheet on said loading means in accordance with a distance measuring result of said distance measuring means.

21. An apparatus according to claim 20, wherein said distance measuring means comprises a distance measuring sensor having an irradiation unit for irradiating light toward said loading means and a light-receiving unit for receiving reflected light from said loading means.

22. An apparatus according to claim 20, wherein said control means controls said shifting means so as to shift said loading means a predetermined amount every time a predetermined number of sheets are loaded on said loading means.

23. An apparatus according to claim 20, wherein said determining means determines an abnormal loaded state in accordance with a change in the distance measuring result of said distance measuring means.

24. An apparatus according to claim 20, wherein said control means controls said shifting means so as to shift said loading means to eliminate an abnormality, when said determining means determines that the abnormality has occurred in the loaded state.

25. An apparatus according to claim 24, wherein said control means controls said shifting means so as to shift said loading means downwardly and then upwardly to eliminate the abnormality.

26. A sheet loading apparatus comprising:

loading means for loading a sheet;

ejecting means for ejecting the sheet onto said loading means;

non-contact distance measuring means, disposed above said loading means, for measuring a distance between a predetermined position and an upper surface of the sheet loaded on said loading means;

shifting means for shifting said loading means in accordance with a distance measuring result of said distance measuring means; and determining means for determining an abnormal loaded state on said loading means in accordance with a change in distance measuring result of said distance measuring means.

27. An apparatus according to claim 21, wherein said distance measuring means comprises a distance measuring sensor having an irradiation unit for irradiating light toward said loading means and a light-receiving unit for receiving reflected light from said loading means.

28. An apparatus according to claim 21, wherein said shifting means shifts said loading means a predetermined amount every time a predetermined number of sheets are loaded on said loading means.

29. An apparatus according to claim 21, wherein said shifting means shifts said loading means to eliminate the abnormal loaded state, when said determining means determines that the abnormal loaded state has occurred.

30. An apparatus according to claim 29, wherein said shifting means shifts said loading means a predetermined amount to eliminate the abnormal loaded state.

31. An apparatus according to claim 30, wherein said shifting means shifts said loading means downwardly and then upwardly to eliminate the abnormal loaded state.

32. A sheet loading apparatus comprising:

loading means for loading a sheet;

ejecting means for ejecting the sheet onto said loading means;

distance measuring means for measuring a distance between a predetermined position and an upper surface of the sheet loaded on said loading means;

shifting means for shifting said loading means in accordance with a distance measuring result of said distance measuring means; and judgment means for judging whether the distance measured by said distance measuring means exceeds a prediction distance according to the number of sheets ejected onto said loading means.

33. An apparatus according to claim 32, wherein said distance measuring means comprises a distance measuring sensor having an irradiation unit for irradiating light toward said loading means and a light-receiving unit for receiving reflected light from said loading means.

34. An apparatus according to claim 32, wherein said shifting means shifts said loading means a predetermined amount every time a predetermined number of sheets are loaded on said loading means.

35. An apparatus according to claim 32, wherein said shifting means shifts said loading means downwardly and then upwardly, when said judgment means judges that the measured distance exceeds the prediction distance.

36. A sheet loading method for loading a sheet ejected from an image forming apparatus, comprising the steps of:

receiving the sheet ejected from the image forming apparatus and conveying the sheet;

loading the sheet conveyed in said receiving step on loading means;

vertically shifting said loading means;

non-contact distance measuring, from above said loading means, to measure a distance to an upper surface of the sheet loaded on said loading means;

controlling said shifting so as to shift said loading means in accordance with a distance measuring result in said distance measuring step; and determining a loaded state of the sheet on said loading means in accordance with a distance measuring result in said distance measuring step.

37. A method according to claim 36, wherein said distance measuring step comprises irradiating light toward said loading means and receiving reflected light from said loading means.

38. A method according to claim 36, wherein said control step controls so as to shift said loading means a predetermined amount every time a predetermined number of sheets are loaded on said loading means.

39. A method according to claim 36, wherein said determining step determines an abnormal loaded state in accordance with a change in the distance measuring result in said distance measuring step.

40. A method according to claim 36, wherein said control step controls so as to shift said loading means to eliminate an abnormality, when it is determined in said determining step that the abnormality has occurred in the loaded state.

41. A method according to claim 40, wherein said control step controls so as to shift said loading means downwardly and then upwardly to eliminate the abnormality.

42. A sheet loading method comprising the steps of:

loading a sheet by a loading means;

ejecting the sheet onto said loading means;

non-contact distance measuring, from above said loading means, to measure a distance between a predetermined position and an upper surface of the sheet loaded on said loading means;

shifting said loading means in accordance with a distance measuring result in said distance measuring step; and determining an abnormal loaded state on said loading means in accordance with a change in distance measuring result in said distance measuring step.

43. A method according to claim 42, wherein said distance measuring step comprises irradiating light toward said loading means and receiving reflected light from said loading means.

44. A method according to claim 42, wherein said loading means is shifted a predetermined amount every time a predetermined number of sheets are loaded on said loading means.

45. A method according to claim 42, wherein said loading means is shifted to eliminate the abnormal loaded state, when it is determined in said determining step that the abnormal loaded state has occurred.

46. A method according to claim 43, wherein said loading means is shifted a predetermined amount to eliminate the abnormal loaded state.

47. A method according to claim 46, wherein said loading means is shifted downwardly and then upwardly to eliminate the abnormal loaded state.

48. A sheet loading method comprising:

loading a sheet by loading means;

ejecting the sheet onto said loading means;

measuring a distance between a predetermined position and an upper surface of the sheet loaded on said loading means;

shifting said loading means in accordance with a distance measuring result in said distance measuring step; and judging whether the distance measured in said distance measuring step exceeds a prediction distance according to the number of sheets ejected onto said loading means.

49. A method according to claim 48, wherein said distance measuring step comprises irradiating light toward said loading means and receiving reflected light from said loading means.

50. A method according to claim 48, wherein said loading means is shifted a predetermined amount every time a predetermined number of sheets are loaded on said loading means.

51. A method according to claim 48, wherein said loading means is shifted downwardly and then upwardly, when said it is judged in said judgment step that the measured distance exceeds the prediction distance.

* * * * *

UNITED STATES PATENT AND TRADEMARK OFFICE

CERTIFICATE OF CORRECTION

PATENT NO. : 6,003,861
DATED : December 21, 1999
INVENTOR(S) : Kenichi Iizumi et al.

It is certified that error appears in the above-identified patent and that said Letters Patent is hereby corrected as shown below:

Drawings,
Sheet 32, Fig. 41, “ROURINE” should read -- ROUTINE --.

Column 3,
Line 52, “difference” should read -- different --.

Column 8,
Line 8, “60” should read -- 600 --.

Column 11,
Line 42, “accordance” should read -- accordance with --.

Column 22,
Lines 36, 41 and 45, “claim 21,” should read -- claim 26, --.

Column 24,
Line 22, “claim 43,” should read -- claim 45, --; and
Line 50, “said” should be deleted.

Signed and Sealed this

Ninth Day of July, 2002

*Attest:*

*Attesting Officer*

JAMES E. ROGAN
*Director of the United States Patent and Trademark Office*